US007536952B2

(12) United States Patent
Winston

(10) Patent No.: US 7,536,952 B2
(45) Date of Patent: May 26, 2009

(54) CONTINUOUS MATERIAL PROCESSING SYSTEMS AND METHODS FOR ARTS AND CRAFTS

(75) Inventor: Jeffrey M. Winston, Anacortes, WA (US)

(73) Assignee: Clearsnap Holding, Inc., Burlington, WA (US)

( * ) Notice: Subject to any disclaimer, the term of this patent is extended or adjusted under 35 U.S.C. 154(b) by 428 days.

(21) Appl. No.: 11/205,256

(22) Filed: Aug. 15, 2005

(65) Prior Publication Data

US 2005/0284319 A1 Dec. 29, 2005

Related U.S. Application Data

(63) Continuation-in-part of application No. 11/054,987, filed on Feb. 9, 2005, now Pat. No. 7,194,954.

(60) Provisional application No. 60/543,731, filed on Feb. 10, 2004, provisional application No. 60/651,878, filed on Feb. 9, 2005, provisional application No. 60/651,775, filed on Feb. 9, 2005, provisional application No. 60/604,184, filed on Aug. 23, 2004.

(51) Int. Cl.
*B41F 5/00* (2006.01)

(52) U.S. Cl. ..... 101/329; 101/327; 401/218

(58) Field of Classification Search ..... 101/327, 101/328, 329, 330, 331; 401/218
See application file for complete search history.

(56) References Cited

U.S. PATENT DOCUMENTS

| | | | |
|---|---|---|---|
| 209,763 | A | 11/1878 | Keeler |
| 321,223 | A | 6/1885 | Keeler |
| 427,229 | A | 5/1890 | French |
| 642,367 | A | 1/1900 | Ray |
| 749,034 | A | 1/1904 | Daut |
| 829,230 | A | 8/1906 | Pope |
| 983,066 | A | 1/1911 | Kjeldaas |
| 1,070,763 | A | 8/1913 | Bauman |
| 1,127,806 | A | 2/1915 | Pells |
| 1,291,057 | A | 1/1919 | Marks |

(Continued)

FOREIGN PATENT DOCUMENTS

| | | |
|---|---|---|
| CH | 151703 | 12/1931 |

(Continued)

*Primary Examiner*—Ren Yan
(74) *Attorney, Agent, or Firm*—Michael R. Schacht; Schacht Law Office, Inc.

(57) ABSTRACT

A material processing system for continuously processing a material defining a destination surface. The material processing system comprises an inking wheel and a handle assembly or a roller press assembly and an auxiliary housing. The handle assembly rotatably supports a first print wheel. The roller press assembly comprises a housing assembly that rotatably supports a second print wheel. The auxiliary housing is adapted to be connected to the housing assembly. The inking wheel is adapted to be connected to the handle assembly and to the adapter assembly. The material processing system is used to apply ink to the image surface in either one of first or second modes. In the first mode, the inking wheel is supported by the handle assembly such that the inking wheel is in contact with the first print wheel. In the second mode, the inking wheel is supported by the auxiliary housing such that the inking wheel is in contact with the second print wheel.

16 Claims, 31 Drawing Sheets

U.S. PATENT DOCUMENTS

| | | | |
|---|---|---|---|
| 1,576,791 | A | 3/1926 | Rosner |
| 1,656,489 | A | 1/1928 | Low |
| 1,909,326 | A | 5/1933 | Wheeler, Jr. |
| 2,576,622 | A | 11/1951 | McBride |
| 3,167,009 | A | 1/1965 | Sloane |
| 3,465,673 | A | 9/1969 | Oppenheim |
| 3,859,915 | A | 1/1975 | Hunter |
| 4,181,560 | A | 1/1980 | Maitland |
| 4,259,568 | A | 3/1981 | Dynesen |
| 4,367,965 | A | 1/1983 | Speitel |
| 4,817,526 | A | 4/1989 | Winston |
| 5,495,800 | A | 3/1996 | Weissbein et al. |
| 5,735,208 | A | 4/1998 | Hummel et al. |
| 6,659,007 | B1 | 12/2003 | Winston |

FOREIGN PATENT DOCUMENTS

| | | |
|---|---|---|
| DE | 231631 | 11/1909 |
| DE | 551219 | 5/1932 |
| DE | 551947 | 6/1932 |
| DE | 1259732 | 1/1968 |
| FR | 2 294 857 | 7/1976 |
| GB | 1 196 169 | 6/1970 |
| IT | 451645 | 9/1949 |

9
18
50
64
16
120
110
56
B
30
22
24
C
24a
58
24b
30
14
20
23
A
32b
29
180
23
32a
42
29
9

CONTINUOUS MATERIAL PROCESSING SYSTEMS AND METHODS FOR ARTS AND CRAFTS

RELATED APPLICATIONS

This application is a continuation-in-part of U.S. patent application Ser. No. 11/054,987 filed Feb. 9, 2005, now U.S. Pat. No. 7,194,954 which claims priority of U.S. Provisional Patent Application Ser. No. 60/543,731 filed Feb. 10, 2004, and claims priority of U.S. Provisional Patent Application Ser. Nos. 60/651,878 filed Feb. 9, 2005, 60/651,775 filed Feb. 9, 2005, and 60/604,184 filed Aug. 23, 2004. The contents of all related applications listed above are incorporated herein by reference.

FIELD OF THE INVENTION

The present invention relates to systems and methods for processing materials used in crafts projects and, more specifically, to such systems and methods that employ a cylindrical inking wheel to apply ink to a cylindrical print or stamp wheel in contact with a material to be processed.

BACKGROUND OF THE INVENTION

The present invention relates material processing systems and methods for arts and crafts. One example of "material processing" as that term is used herein is when an ink impression is formed on an image surface. The ink is applied to a stamp member on which a design is formed in bas relief. The stamp member with ink thereon is brought into contact with the image surface such that ink is transferred to the image surface to form an ink impression or image in a configuration corresponding to the design on the stamp member. The material defining the image surface is the material that is processed. Another example of "material processing" as that term is used herein is forming indentations in and/or applying ink to a strip of clay. In this case, the strip of clay forms the material being processed.

The present invention is of particular importance in the processing of materials used for artistic rather than commercial ink purposes. For example, art stamping uses the same basic ink stamping process as commercial ink stamping but has evolved to allow much finer control over the details and quality of the resulting ink impression. The principles of the present invention may also have application to commercial ink stamping, however.

Material processing systems used by crafters are designed and constructed primarily to obtain a high quality end product, with flexibility of use also being of importance. Considerations such as repeatability of the process, ease of use, and durability are of lesser importance than in the commercial environment.

Ink pad or inking assemblies that form a continuous, repeated ink image are well-known. Such inking assemblies comprise a cylindrical stamping wheel comprising a stamp member defining a cylindrical stamping surface. The design formed in bas relief on the stamp member is formed on the outer surface of the stamp member. The stamp member is mounted on a handle or handle assembly such that the handle can be grasped to roll the stamp member along an ink pad and then along an inking surface to form the desired ink impression on the inking surface. In some continuous inking assemblies, the ink pad is also mounted to the handle such that ink is continuously applied to the outer member of the stamp member as the stamp member rolls along the inking surface.

One such a continuous inking assembly is disclosed in U.S. Pat. No. 4,817,526 for a Rolling Contact Printer with Retractable Inking Wheel. The '526 patent discloses a printing device comprising a print or stamping wheel and an inking assembly. The inking assembly comprises an ink housing and an inking roller that is moveable between a forward position where the inking roller is in contact with the print wheel and a retracted position where the inking roller is spaced from the print wheel. A separate spring is mounted in the housing. The spring urges the inking roller toward the first forward position. A releasable retaining structure is positioned on the ink housing to hold the inking assembly in the retracted position.

The need exists for improved material processing systems and methods for arts and crafts that are capable of continuously processing arts and crafts materials.

SUMMARY OF THE INVENTION

The present invention may be embodied as a material processing system for continuously processing a material defining a destination surface. The material processing system comprises a handle assembly, a roller press assembly, an auxiliary housing, and an inking wheel. The handle assembly rotatably supports a first print wheel. The roller press assembly comprises a housing assembly that rotatably supports a second print wheel. The auxiliary housing is adapted to be connected to the housing assembly. The inking wheel is adapted to be connected to the handle assembly and to the adapter assembly. The material processing system is used to apply ink to the image surface in either one of first or second modes. In the first mode, the inking wheel is supported by the handle assembly such that the inking wheel is in contact with the first print wheel. In the second mode, the inking wheel is supported by the auxiliary housing such that the inking wheel is in contact with the second print wheel

DETAILED DESCRIPTION OF THE PREFERRED EMBODIMENTS

Figure 1:
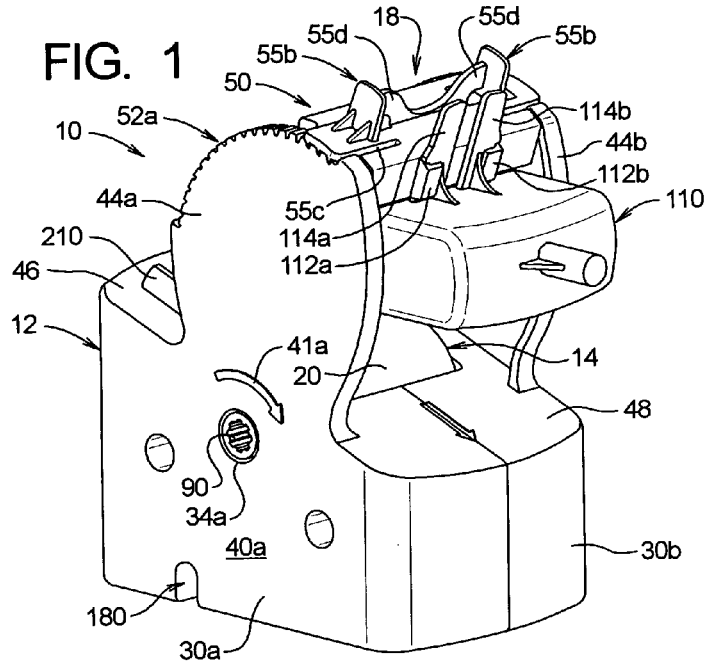
FIG. 1 is a perspective view of a roller press system of the present invention.
Figure 2:
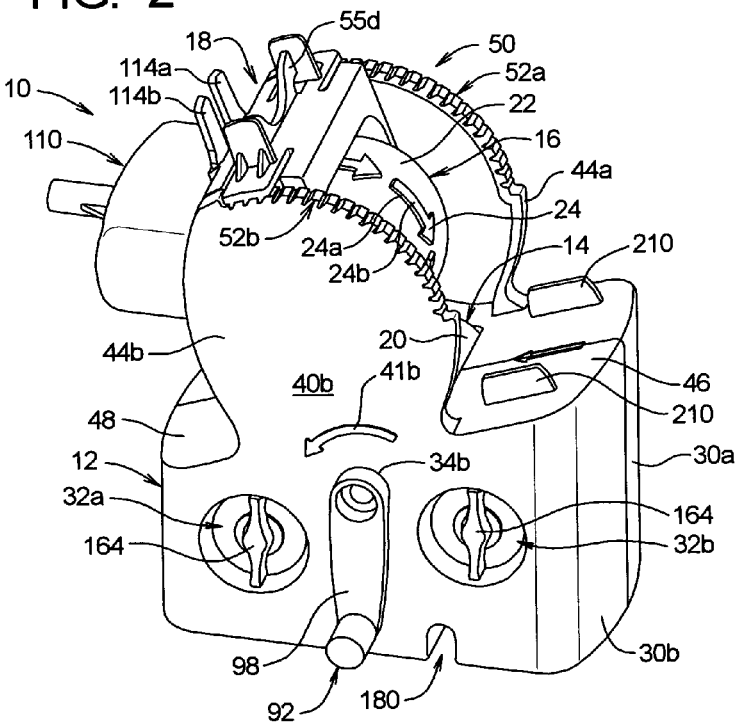
FIG. 2 is another perspective view of the roller press system depicted in FIG. 1.
Figure 3:
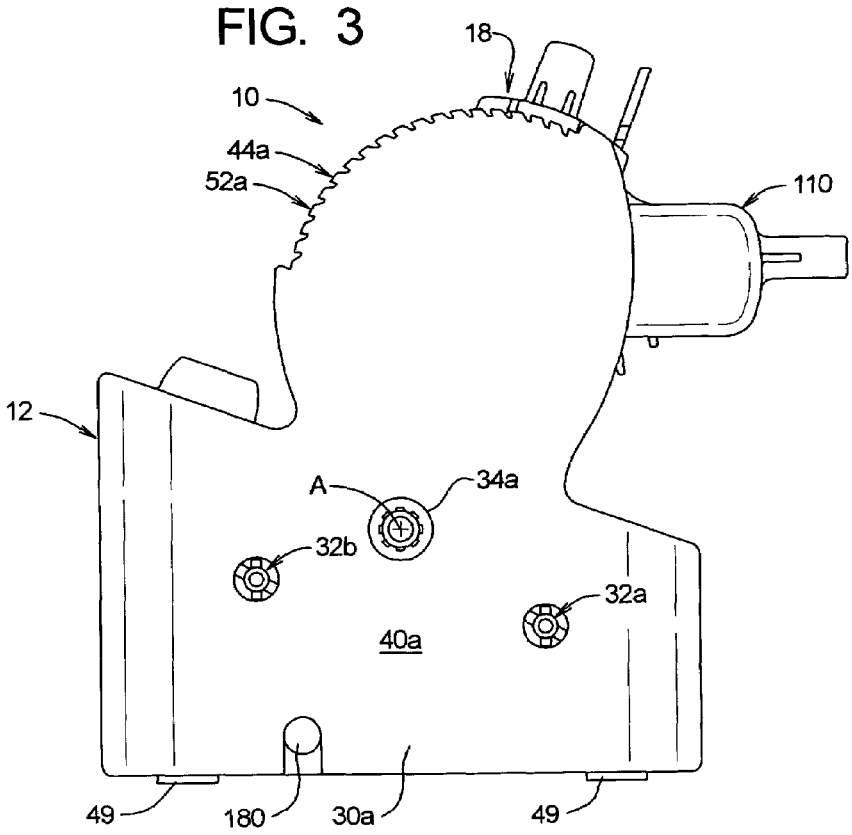
FIG. 3 is a side elevation view of the roller press system of FIG. 1.
Figure 4:
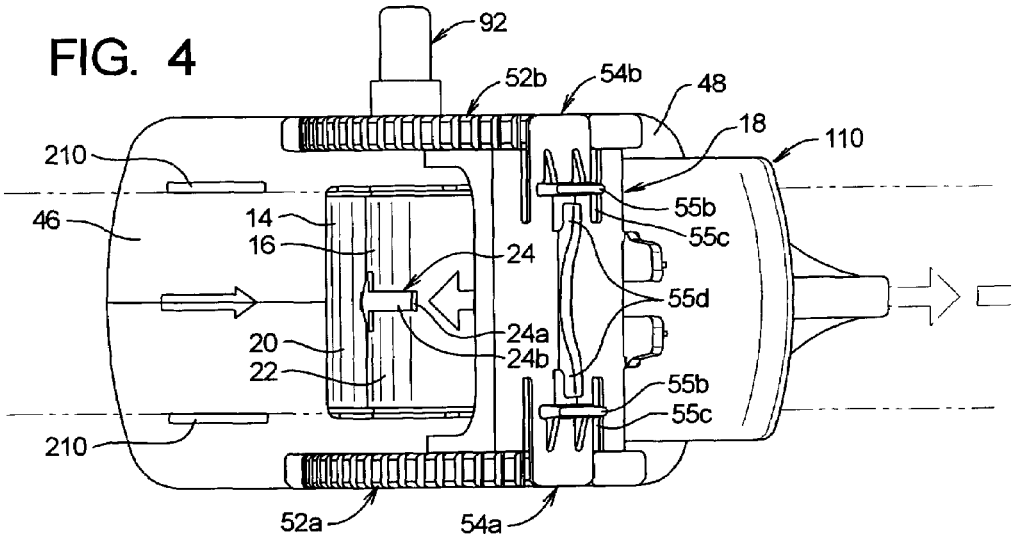
FIG. 4 is a top plan view of the roller press system of FIG. 1.
Figure 5:
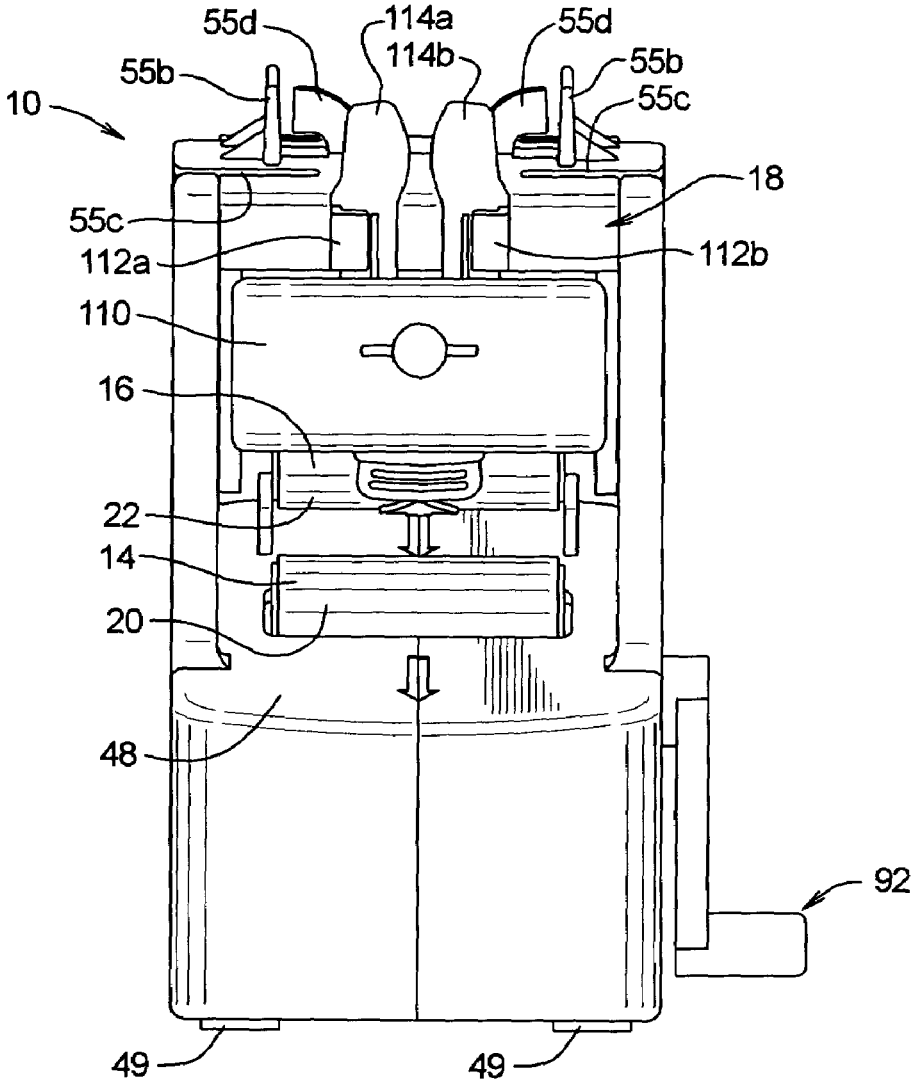
FIG. 5 is a top plan view of the roller press system of FIG. 1.

Referring now to the drawing, depicted in FIGS. 1 and 2 is an example of a roller press system 10 constructed in accordance with, and embodying, the principles of the present invention. The example roller press system 10 may be embodied in forms other than that depicted in the drawings. In addition, the example roller press system 10 is shown in one example configuration, but other possible configurations will be described below. The example roller process system 10 forms a material processing system for arts and crafts materials.

The roller press system 10 comprises a housing 12, a first roller 14, and a second roller 16. The first roller 14 is supported by the housing 12 for axial rotation about a first axis A. The second roller 16 is supported for axial rotation about a second axis B relative to a carriage 18. The carriage 18 is in turn supported by the housing 12 for pivotal rotation about a third axis C. The first, second, and third axes, A, B, and C are all parallel as perhaps best shown in FIGS. 6 through 9.

Figure 6:
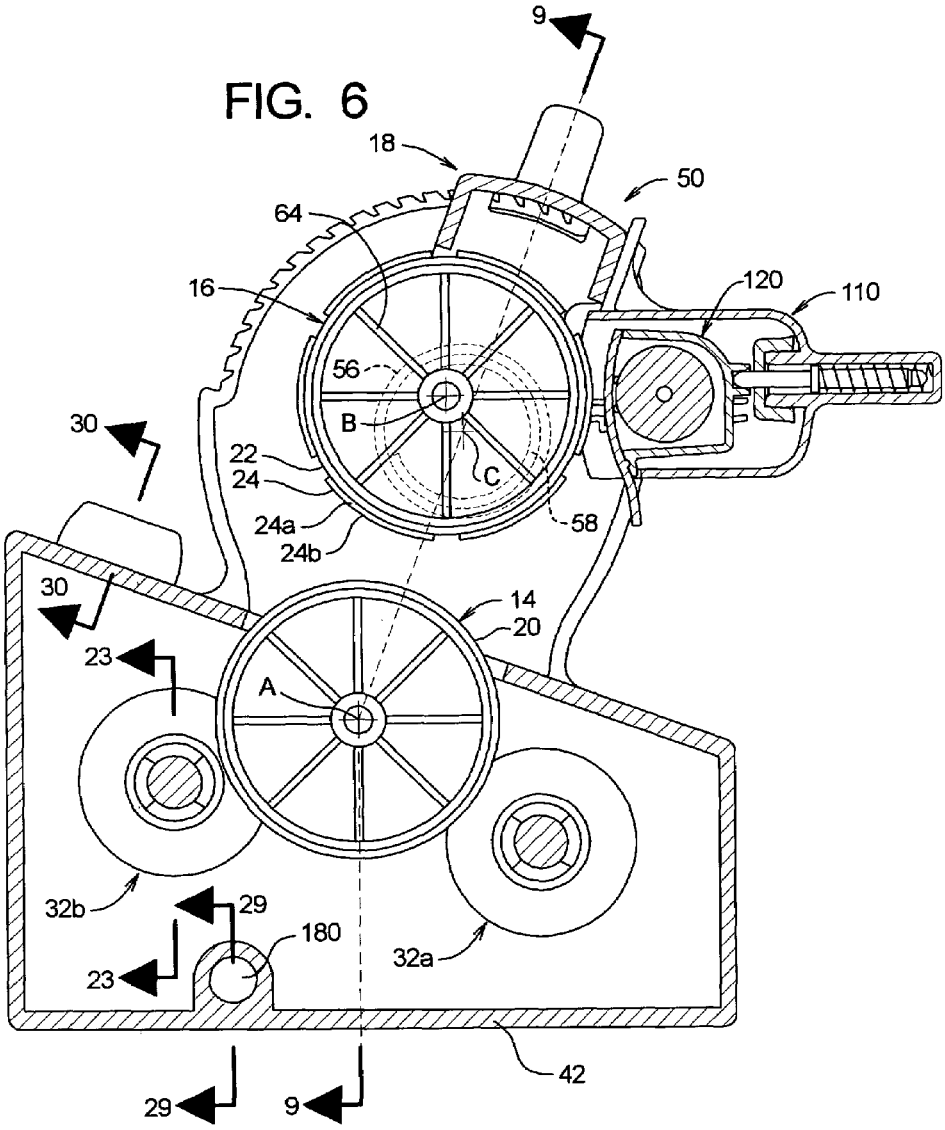
FIG. 6 is a side elevation sectional view of the roller press system of FIG. 1.
Figure 7:
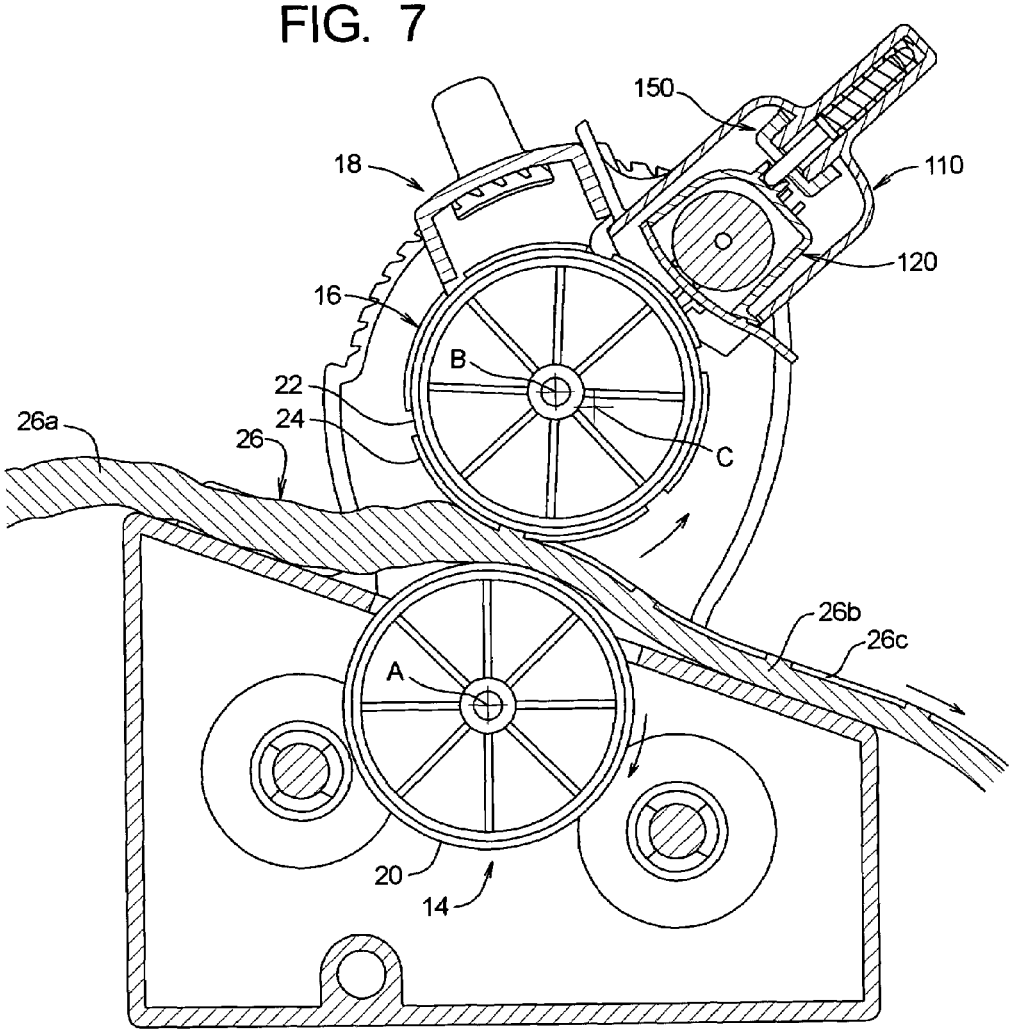
FIG. 7 is a side elevation sectional view of the roller press system of FIG. 1 processing a pliable material.
Figure 8:
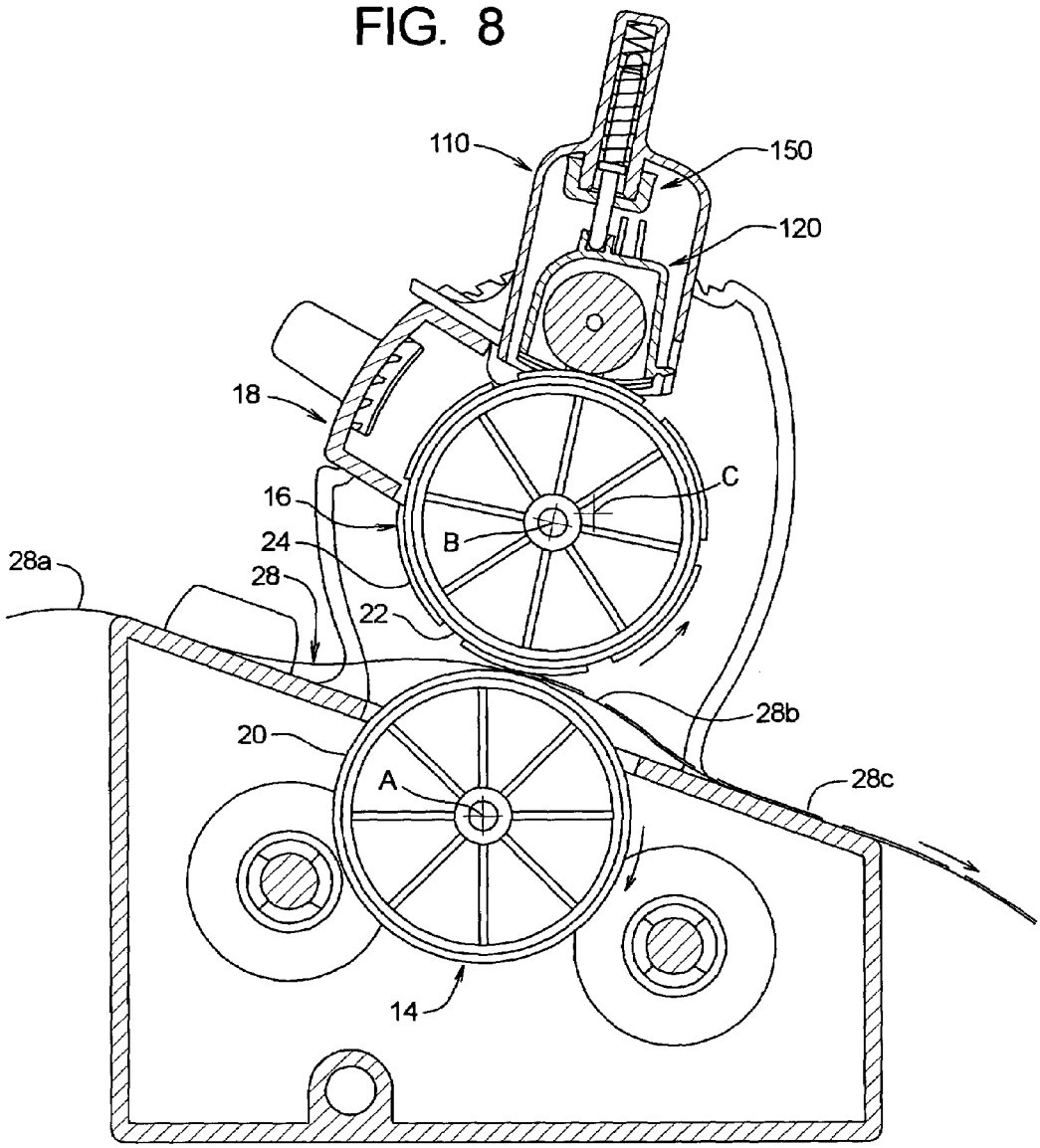
FIG. 8 is a side elevation sectional view of the roller press system of FIG. 1 processing a sheet of paper.

FIGS. 6 and 8 show that the carriage 18 rotates about the carriage axis C such that the second roller 16 moves within a continuum of positions between a first position shown in FIG. 6 and a second position shown in FIG. 8. In the first position, the second roller 16 is spaced a first predetermined distance from the first roller 14. In the second position, the second roller 16 can be brought into contact with the first roller 14. In addition, the second roller 16 may be placed in any one of a number of intermediate positions between the first and second position. FIG. 7 specifically shows the second roller 16 in a first intermediate position.

FIGS. 1 and 2 show that the first roller 14 defines a first processing surface 20. FIGS. 1 and 2 also show that the second roller 16 defines a second processing surface 22. The first and second processing surfaces 20 and 22 are substantially similar in diameter and length along the axes A and B, but rollers of different diameters and lengths may also be used.

In the example roller press system 10, processing projections 24 extend from the second processing surface 22. The processing projections 24 can take any one of a number of forms depending on the specific use of the roller press system 16. For illustration purposes, the example processing projections 24 are arrows defined by radially extending sidewalls 24*a* and outer surfaces 24*b* that follow the general outline of the cylindrical second processing surface 22.

One example of a roller that may be used as the second roller 16 is a conventional cylindrical rubber stamp as is commonly used to form continuous ink images on a sheet of material. However, the processing projections can be made of different materials and in different forms depending on the particular use of the roller press system 10.

In addition, in some configurations processing projections are formed on neither the first processing surface 20 nor the second processing surface 22. In other alternative configurations, processing projections are placed only on the first processing surface 20 or on both the first processing surface 20 and the second processing surface 22. In any case where processing projections are used, the processing projections may be used to apply ink to a flat sheet, to form indentations in a malleable sheet, and to apply both ink and indentations to a malleable sheet. If neither of the rollers 14 and 16 comprises processing projections, the process implemented by the roller press system 10 can be used to convert the material 26*a* of random thickness into a processed material having a constant thickness.

The roller press systems 10 may be used to process material of difference sizes, thicknesses, and compositions. For example, in FIG. 7 the roller press system 10 is shown processing a material 26 formed of a malleable substance such as polymer modeling clay. In FIG. 8, the roller press system 10 is shown processing a material 28 in the form of a thin material such as fabric, paper, or the like.

In addition to the different types of materials that may be processed, the process itself may be different. For example, when processing the malleable material 26 shown in FIG. 7, the process creates from the unprocessed form 26*a* and elongate strip of the processed material 26*b* having a relatively constant thickness and also imprinted portions 26*c* corresponding to the processing projections 24 on the second roller 16. If the malleable material 26 is a hardenable clay substance, the material 26*b* in its processed form can be shaped and hardened in the form of a pendant, bracelet, or other craft item.

Turning back to the sheet material 28 processed as shown in FIG. 8, the processing projections 24 typically do not form permanent indentations in the processed material 28*b*. Instead, the process shown in FIG. 8 is an inking process in which ink is applied to the processing projections 24 and subsequently deposited on the unprocessed material 28*a* to form the processed material 28*b*, in which ink 28*c* is deposited thereon. The ink 28*c* dries and forms a visible and/or tactile design on the material 28*b* corresponding to the shape of the processing projections 24.

As suggested above, the first and second rollers 14 and 16 may be made of other compositions and shapes. For example, instead of using processing projections as described above, the side surfaces 24*a* may be extended and the projections 24 hollowed such that the processing projections extend completely through a malleable material in a manner similar to that of a cookie cutter. In this case, the resulting processed malleable material may have openings formed therein formed in the shape of the processing projections. In addition, discreet portions of the malleable material will remain within the processing projections and may be removed to yield many small craft items of uniform shape and thickness.

The concept of cutting out a portion of the material being processed may also be applied to sheet material such as the material 28 described above. In this case, the processing projections would have blade edges defining a closed loop that pierce the sheet material to remove a portion therefrom, resulting in a strip having regularly shaped holes of a predetermined design. In addition, the processing projections 24 may take the shape of annular ribs or blades extending radially from one or both of the rollers 14 and 16. These blades can cut the material being processed into one or more strips of uniform width.

Given the foregoing, it should be apparent that the present invention provides the crafter with significant flexibility in processing materials in may different sizes, shapes, and compositions and allowing the use of many different processes.

With the foregoing understanding of the basic operation of the roller press system 10, the details of construction and operation of the roller press system 10 will now be described in further detail.

Figure 9:
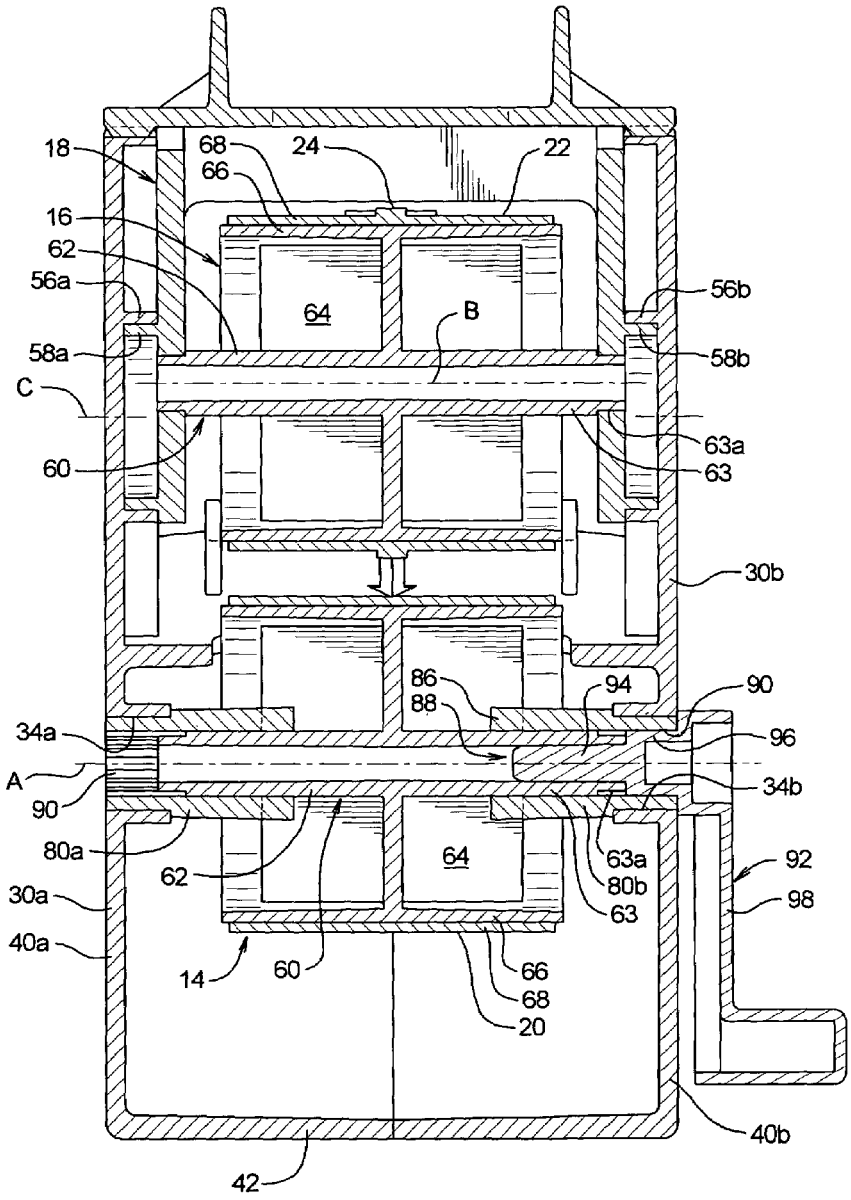
FIG. 9 is a front elevation sectional view taken along lines 9-9 in FIG. 6.

Initially, FIGS. 1 and 9 illustrate that the example housing 12 comprises first and second housing members 30*a* and 30*b*. These housing members 30*a* and 30*b* are connected together using housing attachment assemblies 32*a* and 32*b* such as will be described below with reference to FIGS. 23-28. In addition, axle openings 34*a* and 34*b* are formed in the housing members 30*a* and 30*b*, respectively, as shown in FIGS. 1 and 9.

The housing 12 defines side walls 40*a* and 40*b*, in which the axle openings 34*a* and 34*b* are formed, and a bottom wall 42. Carriage supports 44*a* and 44*b* extend from the side walls 40*a* and 40*b*, respectively. The housing further defines an infeed surface 46 for supporting the unprocessed material 26*a*, 28*a* and an outfeed surface 48 for supporting the processed material 26*b*, 28*b*. Arrows 41*a* and 41*b* are formed or imprinted on the side walls 40*a* and 40*b*, respectively, to indicate a direction of rotation of the first processing surface 20 during normal use of the system 10. Feet 49 are secured to the bottom wall 42. The example feet 49 are formed of a rubber-like material that stabilized the system 10 during normal use by increasing friction and reduces movement.

The carriage 18 is attached to the housing 12 using a carriage mounting system 50. The example mounting system 50 comprises ratchet surfaces 52*a* and 52*b* formed on the carriage supports 44*a* and 44*b* and pawl portions 54*a* and 54*b* formed on the carriage 18. In addition, carriage support portions 56*a* and 56*b* are formed on the carriage supports 44*a* and 44*b*, while carriage pivot portions 58*a* and 58*b* are formed on the carriage 18.

Figure 14:
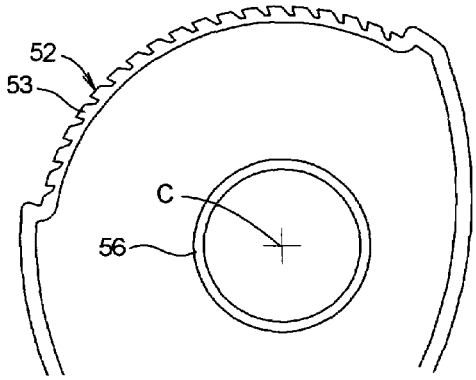
FIG. 14 is a side elevation view illustrating a gear portion of the position lock system depicted in FIG. 12.
Figure 15:
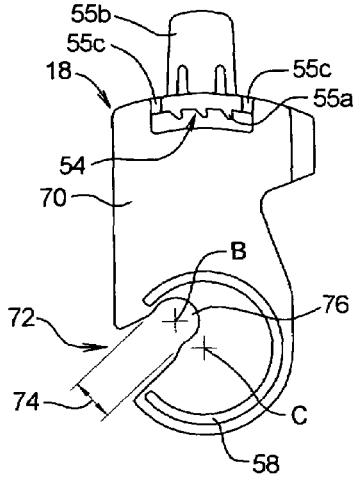
FIG. 15 is a side elevation view depicting a carriage portion of the position lock system depicted in FIG. 12.
Figure 16:
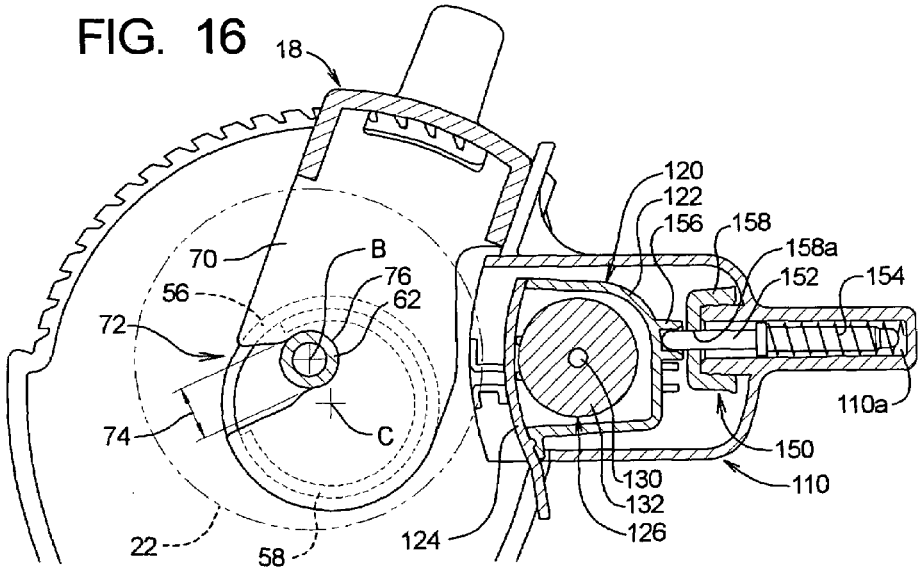
FIG. 16 is a side elevation view depicting the interaction of the gear portion and the carriage portion of the position lock system depicted in FIG. 12.

As perhaps best shown in FIGS. 14 and 15, the carriage support portions 56*a* and 56*b* are circular walls extending from opposing surfaces of the carriage supports 44*a* and 44*b*. FIGS. 15 and 16 shows that the carriage pivot portions 58*a* and 58*b* are walls that extend from outwardly facing surfaces of the carriage 18. The walls forming the pivot portions 58*a* and 58*b* are arcuate but, for reasons that will be explained below, extend through an angle of approximately 270 degrees, leaving a gap of approximately 90 degrees. As perhaps best shown in FIGS. 6, 7, and 8, the carriage support portions 56*a* and 56*b* and the carriage pivot portions 58*a* and 58*b* are centered about the axis C defined above and engage each other to allow the carriage 18 to pivot relative to the housing 12 as generally described above.

Referring now to FIGS. 14 and 15, it can be seen that the ratchet surfaces 52 define ratchet teeth 53 and the pawl portions 54 define pawl teeth 55*a*. The ratchet surfaces 52 are semi-circular and centered about the axis C such that the pawl teeth 55*a* remain adjacent to the ratchet teeth 53 as the carriage 18 rotates between the first and second positions relative to the housing 12.

Figure 12:
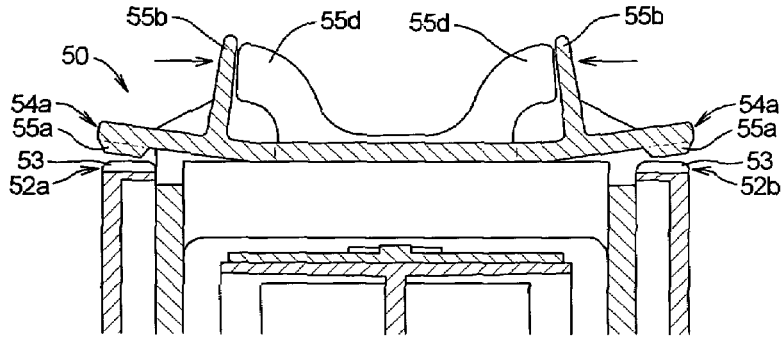
FIG. 12 is a front partial section view illustrating a position lock system of the roller press system of FIG. 1.
Figure 13:
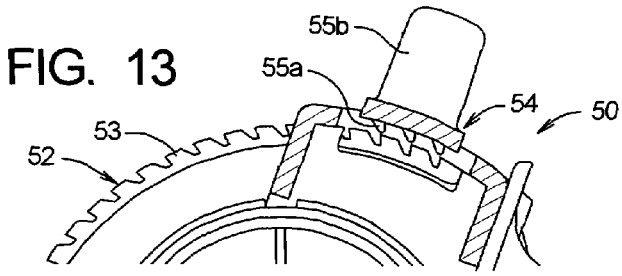
FIG. 13 is a side partial section view illustrating the position lock system depicted in FIG. 12.

In use, the ratchet teeth 53 engage the pawl teeth 55*a* to inhibit rotation of the carriage 18 from a desired position relative to the housing 12. If the crafter wishes to rotate the carriage 18 to a new desired position, the crafter pinches the pawl grips 55*b* together to disengage the pawl teeth 55*a* from the ratchet teeth 53 as shown in FIGS. 12 and 13. Pawl slits 55*c* formed in the carriage 18 adjacent to the pawl teeth 55*a* facilitate disengagement of the pawl teeth 55*a* from the ratchet teeth 53. Pawl stops 55*d* are formed behind the pawl grips 55*b* to prevent the pawl portions 54 from being overextended during normal use. When the carriage 18 is in the new desired position, the pawl grips 55*b* are released to allow the pawl teeth 55*a* to reengage the ratchet teeth 53.

Referring now to FIG. 9, the example first and second rollers 14 and 16 will be described in further detail. The example rollers 14 and 16 are in many respects the same. While the rollers 14 and 16 need not be the same in any respect, the use of similar rollers 14 and 16 results in a modular system in which the rollers 14 and 16 may be interchanged and/or used in other continuous inking devices. Because of the similarity between the example rollers 14 and 16, the following discussion applies to both rollers unless otherwise noted.

The rollers 14 and 16 comprise a hub 60 having an axle 62. The axle 62 is generally cylindrical and defines a shaft 63 having a reduced diameter portion 63*a* at each end. The shaft 63 further comprises a shaft surface 63*b*. Extending from the axle 62 are radial plates 64 that define a cylindrical base portion 66. In the example rollers 14 and 16, a processing layer 68 is formed on base portion 66 to define the processing surfaces 20 and 22, respectively. The hubs 60 of the rollers 14 and 16 are supported at the reduced diameter end portions 63*a* for rotation about the axes A and B, respectively.

More specifically, referring initially to the second roller 16, the carriage 18 defines a standoff portion 70 and an axle notch 72. The axle notch 72 in turn defines a restricted portion 74 and an axle portion 76. The axle notch 72 allows the reduced diameter portions 63*a* of the axle 62 of the second roller 16 to enter the axle portion 76. The restricted portion 74 maintains reduced diameter portions 63*a* within the axle portion 76 under normal use, but allow the reduced diameter portions 63*a* to be removed from the axle portion 76 by deliberate application of manual force. As perhaps best shown in FIG. 9, the axle notches 72 support each end of the axle 62 of the second roller 16 such that the roller 16 axially rotates about the axis B. The gap in the carriage pivot portion 58 described above accommodates the axle notch 72.

Figure 10:
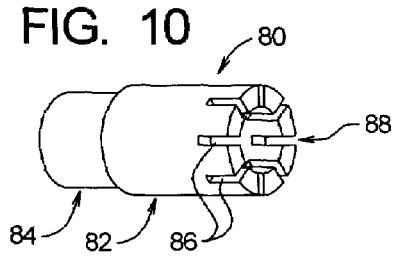
FIG. 10 is a perspective view of a crank bushing of the system of FIG. 1.
Figure 11:
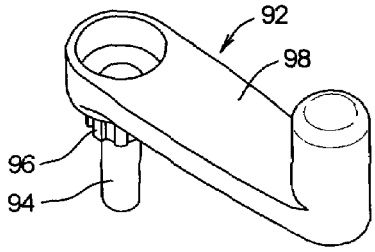
FIG. 11 is a perspective view of a crank member of the system of FIG. 1.

The first roller 14 is supported from the housing 12 using axle bushings 80. As shown in FIG. 10, the axle bushings 80 comprise an inner portion 82 and an outer portion 84. Slots 86 are formed at the end of the outer portion 84. The axle bushings 80 further define a bushing passageway 88. An internal gear portion 90 extends around the passageway 88 at the outer portion 84.

To mount the first roller 14 onto the housing 12, the axles bushings 80 are pressed onto each end of the axle 62 of the first roller 14, with the bushing passageway 88 receiving the ends of the axle 62. The slots 86 in the bushings 80 are radially spaced to receive the radial plates 64 of the hub 60. Axial rotation of the bushings 80 is thus positively transferred to the axle, and vice versa.

The outer portions 84 of the bushings 80 are received within the axle openings 34 as shown in FIG. 9. The hub 60 is thus securely supported by the housing 12, while the axle 62, and thus the hub 60, may axially rotate about axis A.

To facilitate rotation of the first roller 14, a crank 92 is provided. The crank 92 defines an insert portion 94 and a gear portion 96. The insert portion 94 extends through the bushing passageway 88 and into an axle passageway 62*a* defined by the axle. The gear portion 96 of the crank 92 engages the gear portion 90 of the axle bushing 80. A handle arm 98 extends at a right angle to the insert portion 94 and gear portion 90 such that pivoting the arm 98 around the axle A causes the first roller 14 to axially rotate about the axle A. The gear portions 90 and 96 positively engage each other and the slots 86 positively engage the radial plates 64 to allow efficient transmission of energy from the arm 98 to the roller 14.

The crank 92 may be inserted into the axle bushing 80 on either end of the axle 62 of the roller 14, allowing the crafter to use either hand to rotate the roller 14 using the crank 92.

The example roller press system 10 is provided with an auxiliary housing 110 to facilitate the connection of auxiliary components to the carriage 18. As shown in FIG. 8 and generally described above, the roller press system 10 may be used to apply ink to the material being processed. In addition, the craft may wish to apply other fluids, such as adhesives, acids, hardeners, and the like, to the material being processed. The auxiliary housing 110 may be adapted to apply fluids to the second roller 16 for transfer to the working material.

The auxiliary housing 110 may have other uses as well, but the transfer of fluids to the roller 16 will be described herein as an example. In particular, the auxiliary housing 110 will be described in the context of applying ink to the second roller 16 for transfer to the working material.

As perhaps best shown in FIG. 1, auxiliary rails 112*a* and 112*b* are formed on the carriage 18. Auxiliary housing prongs 114*a* and 114*b* extend from an auxiliary housing member 116 of the auxiliary housing 110. The rails 112*a* and 112*b* receive the prongs 114*a* and 114*b* to detachably attach the auxiliary housing 110 to the carriage 18. Other attachment systems may be used in place of the rails 112 and prongs 114.

The example auxiliary housing 110 is adapted to contain a cartridge assembly 120 comprising a cartridge housing 122, a cartridge cover 124, and an auxiliary roller 126. A cartridge tab 128 extends from the cartridge housing 122. The auxiliary housing 110 may be adapted to support the roller 126 directly, but the use of a separate cartridge assembly 120 allows commercially available ink roller cartridges to be used with the roller press system 10.

The auxiliary roller 126 comprises a roller axle 130 and a flexible, ink-absorbent roller member 132 supported thereby. Roller washers 134 are supported by the roller axle 130 on each end of the roller member 132 to stabilize the ends of the roller member 132 when the roller member 132 is under compression. The roller member 132 is impregnated with ink such that ink is transferred to an item contacting the roller surface.

The cartridge housing 122 defines opposing axle grooves 136 in which are formed lock projections 138. The auxiliary roller 126 is inserted into the cartridge housing 122 such that the ends of the roller axle 130 are received by the axle grooves 136. Pressing the auxiliary roller 126 forces the ends of the axle 130 over the lock projection 138. The lock projection 138 inhibits movement of the ends of the axle 130 back out of the axle grooves 136; the grooves 136 thus attach the auxiliary roller 126 to the cartridge housing 122, allowing axial rotation of the roller member 132 relative to the cartridge housing 122 during normal use. To remove the auxiliary roller from the cartridge housing 122, deliberate force may be applied to the roller axle 130 to force the roller ends past the lock projections 138.

Figure 19:
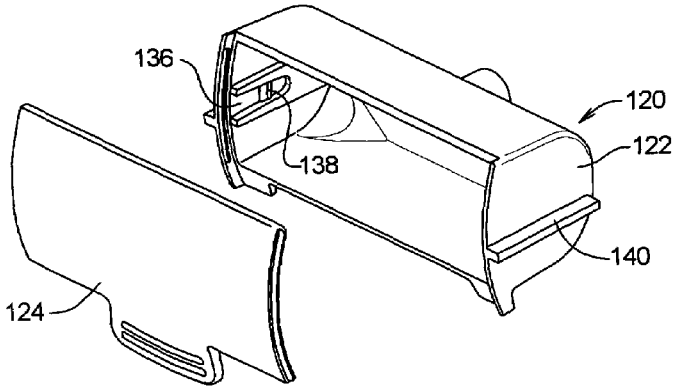
FIG. 19 is a perspective view of an ink cartridge housing that may be used by the ink cartridge assembly depicted in FIGS. 17 and 18.
Figure 20:
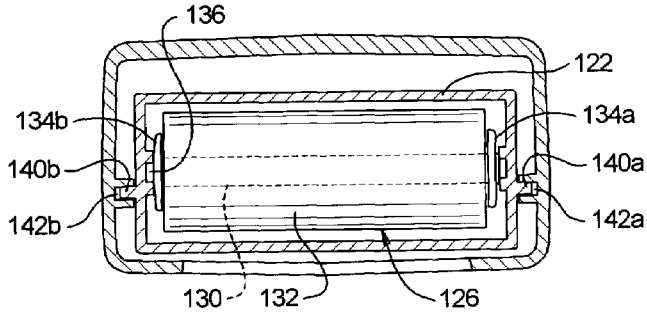
FIG. 20 is a front section view of an ink cartridge assembly as shown in FIGS. 17 and 18.
Figure 21:
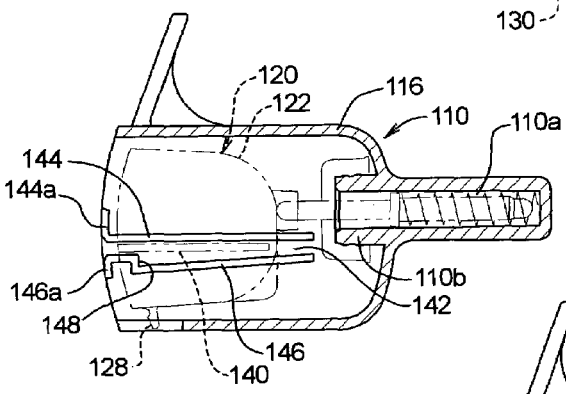
FIGS. 21 and 22 are side elevation cutaway views depicting the use of the ink cartridge assembly of the roller press system.
Figure 22:
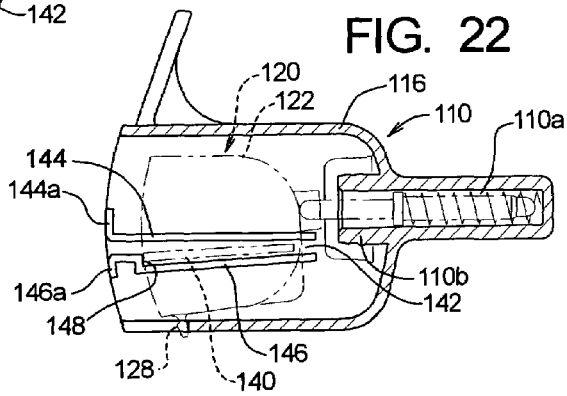

As perhaps best shown in FIGS. 19 and 20, formed on the outside of the cartridge housing 122 are cartridge mounting rails 140. FIGS. 20-22 show that the mounting rails 140 are adapted to be received within cartridge mounting channels 142 formed on the inside of the auxiliary housing 110. The mounting channels 142 are formed by first and second channel walls 144 and 146. The first channel wall 144 is substantially straight, but the second channel wall 146 contains a jog portion 148. The channel walls 144 and 146 define lip portions 144*a* and 146*a*.

In use, the cartridge housing 122 is inserted into the auxiliary housing 110 in an aligned configuration as shown in FIG. 21 until the mounting rails 140 clear the jog portion 148 of the second channel wall 146. The lip portions 144*a* and 146*a* prevent the cartridge housing 122 from being inserted into the auxiliary housing 110 with the rails 140 above or below the channel walls 144 and 146.

The cartridge housing 122 is then angled as shown in FIG. 22 such that the rails 140 rest against the jog portion 148. The cartridge tab 128 facilitates movement of the cartridge housing 120 from the aligned configuration and the angled configuration in which the mounting rails 140 engage the jog portion. The cartridge housing 122 is in a retracted position when the rails 140 rest against the jog portion 148 as shown in FIG. 22.

Figure 17:
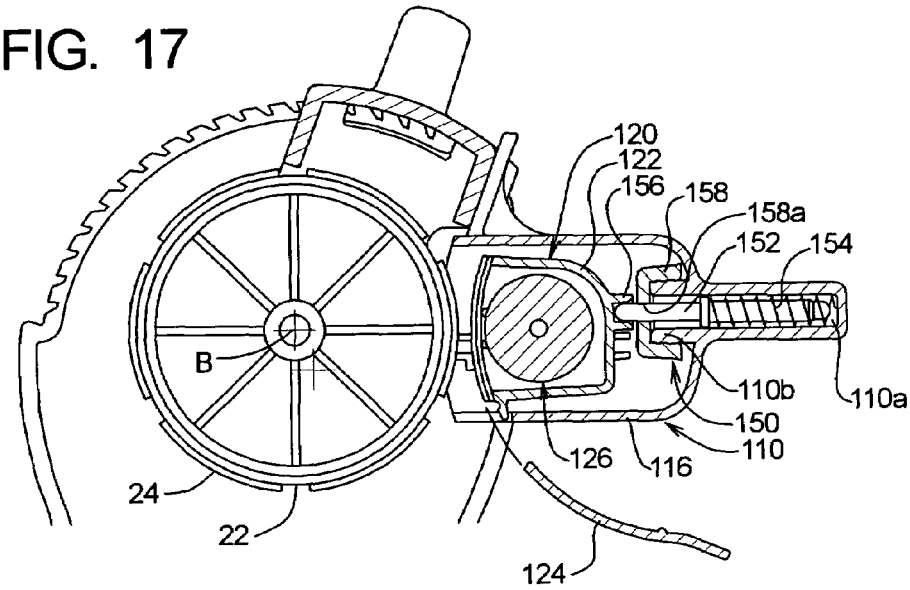
FIGS. 17 and 18 are side elevation views depicting the interaction of the carriage portion of the position lock system and an ink cartridge assembly detachably attached thereto.
Figure 18:
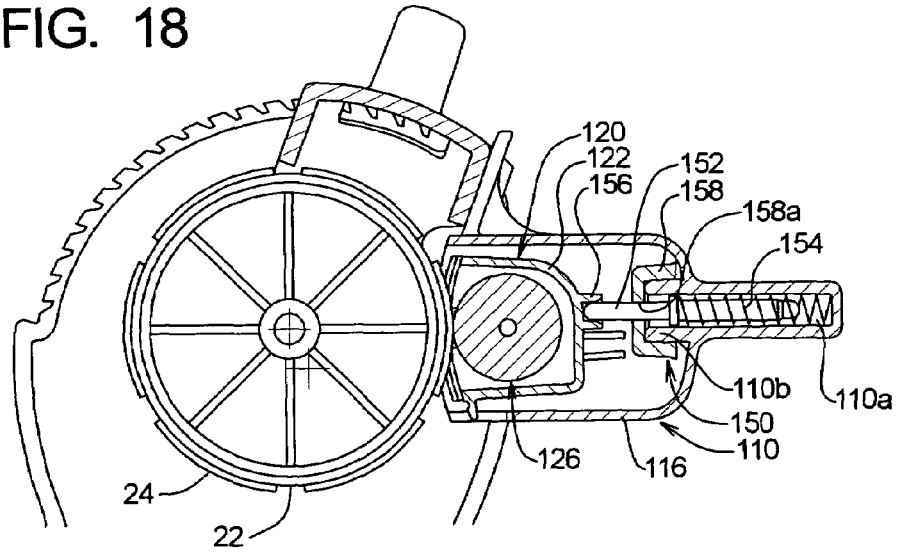

As shown in FIG. 8, the auxiliary roller 126 comes into contact with the second roller 16 to apply ink thereto. To enhance the transfer of ink from the auxiliary roller 126 to the second roller 16, a biasing assembly 150 is provided. The biasing assembly 150 comprises a biasing post 152 supported within the auxiliary housing 110 for movement between rearward (FIG. 17) and forward (FIG. 18) positions. The biasing assembly 150 further comprises a biasing spring 154 arranged to force the biasing post 152 from the rearward into the forward position.

A rearward end of the biasing post 152 and the biasing spring 154 are arranged within a spring chamber 110*a* defined by the auxiliary housing 110. A biasing cap 158 engages a support portion 110*b* of the auxiliary housing 110. The biasing cap 158 defines a cap opening 158*a* through which the biasing post 152 extends. A forward end of the biasing post 152 is received by a biasing socket 156 formed by the cartridge housing 120.

The biasing cap 158 is detachably attached to the support portion 110*b* of the auxiliary housing 110 to facilitate assembly of the biasing assembly 150. In particular, the biasing post 152 and biasing spring 154 are inserted into the spring chamber 110*a*. The biasing cap 158 is then secured to the support portion 110*b* with the biasing post 152 extending through the cap opening 158*a*. The biasing cap 158 may be secured to the support portion 110*b* using friction, a snap fit, threads, adhesives, or the like.

Therefore, as the cartridge housing 120 is inserted into the auxiliary housing 110 as described above, the biasing post 152 is moved into its rearward position against the force of the biasing spring 154. The biasing cap 158 supports the biasing post 152 for movement between the rearward and forward positions.

Angling the cartridge housing 120 relative to the auxiliary housing 110 as shown in FIG. 22 causes the biasing spring 154 to force the cartridge mounting rails 140 against the jog portion 148 of the second channel rail 146, thereby holding the cartridge housing 120 in the retracted position. This process may be reversed to remove the cartridge housing 120 from the auxiliary housing 110. The cartridge lid 124 may be removed and replaced with the cartridge housing 120 in the retracted position.

In use, with the cartridge lid 124 removed, the cartridge housing 120 is placed in the aligned position such that the biasing assembly 150 forces the roller member 132 against the second roller 116. As the second roller 116 rotates to deposit ink on the working material 26 or 28, new ink is continuously applied to the roller 116.

As generally described above, the housing 12 is formed of first and second housing members 30*a* and 30*b* connected together by first and second attachment assemblies 32*a* and 32*b*. The use of separate housing members 30*a* and 30*b* allows the housing 12 to be disassembled. When the housing 12 is disassembled, the first and second rollers 14 and 16 can be removed, replaced, or switched, and alternate rollers of different types may be placed in the positions of the first and second rollers 14 and 16 as shown and described herein.

Alternative systems for allowing removal and replacement of the rollers 114 and 116 may be used, however. For example, the rollers may be inserted into and removed from the housing 12 through a bottom opening.

In the example housing 10, the housing members 30*a* and 30*b* are attached using the attachment assemblies 32*a* and 32*b* as follows. The example attachment assemblies 32*a* and 32*b* are identical and will not be described separately.

Figure 23:
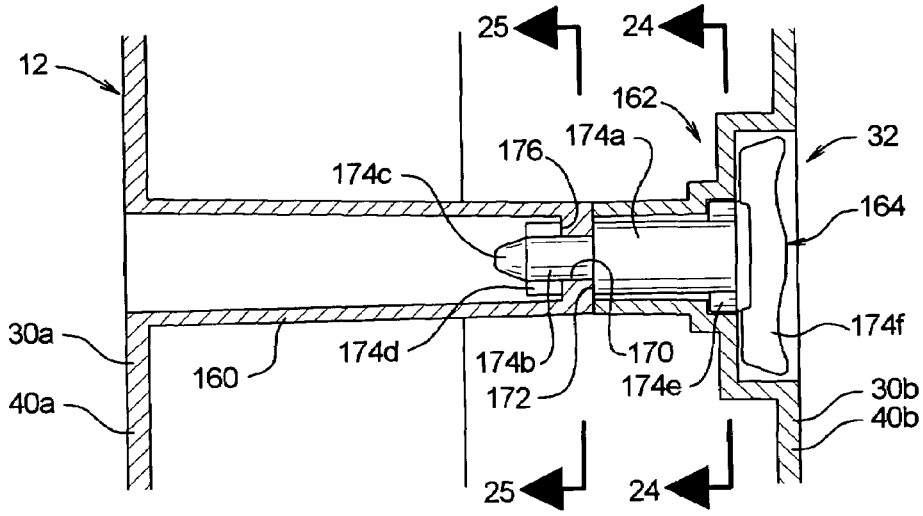
FIG. 23 is a cutaway view taken along lines 23-23 in FIG. 6 depicting a housing attachment assembly in an attached configuration.
Figure 26:
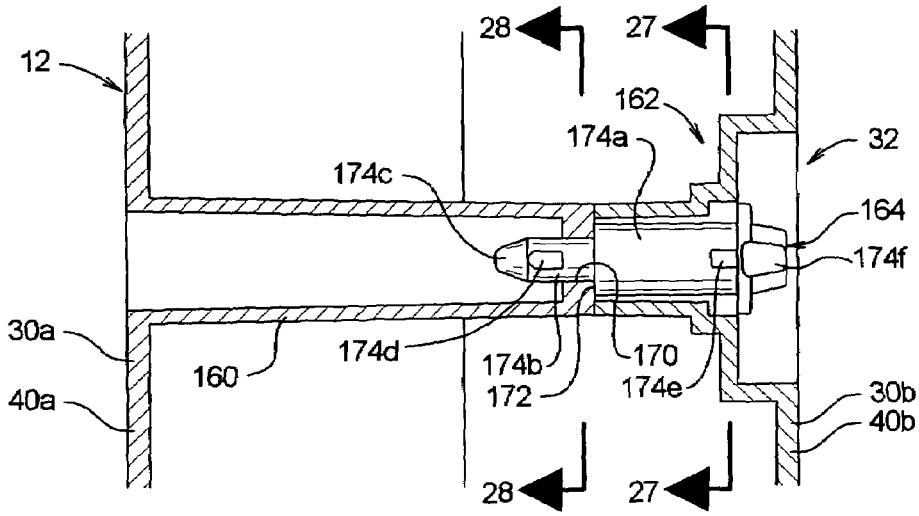
FIG. 26 is a cutaway view taken along lines 23-23 in FIG. 6 depicting a housing attachment assembly in a detached configuration.

Referring now to FIGS. 23 and 26, it can be seen that the example attachment assemblies 32 comprise an attachment post 160, an attachment projection 162, and an attachment key 164. The attachment post 160 extends inwardly from the side wall 40*a* of the housing member 30*a*. The attachment projection 162 extends from the opposite side wall 40*b* of the other housing member 30*b* towards the attachment post 160. A post opening 170 is formed by the end of the attachment post 160, while a key opening 172 is formed by the attachment projection 162.

The attachment key 164 comprises an intermediate portion 174*a*, a reduced diameter portion 174*b*, an end portion 174*c*, one or more clamp projections 174*d*, a limit portion 174*e*, and a knob portion 174*f*.

Figure 27:
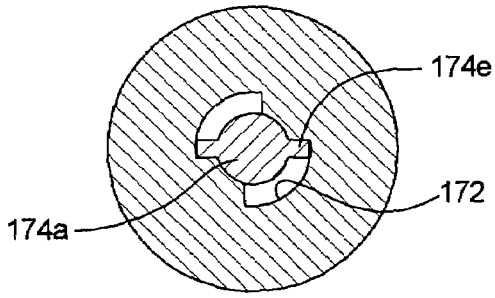
FIG. 27 is a section view taken along lines 27-27 in FIG. 26 depicting details of the housing attachment assembly depicted therein.
Figure 28:
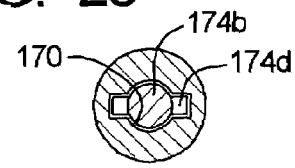
FIG. 28 is a section view taken along lines 28-28 in FIG. 23 depicting details of the housing attachment assembly depicted therein.

When the housing parts 30*a* and 30*b* are properly mated, the post opening 170 and the key opening 172 are aligned such that clamp projections 174*d* of the key 164 can be passed through both openings 170 and 172 in a first configuration as shown in FIG. 26-28. In this first configuration, the limit portion 174*e* engages the attachment projection 162 to prevent further movement of the key 164 through the openings 170 and 172 (FIGS. 23 and 26).

Figure 24:
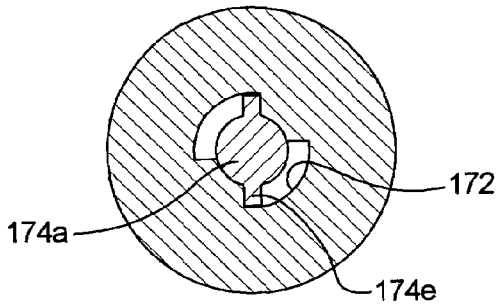
FIG. 24 is a section view taken along lines 24-24 in FIG. 23 depicting details of the housing attachment assembly depicted therein.
Figure 25:
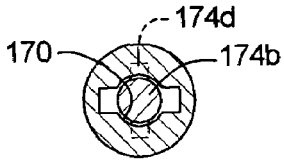
FIG. 25 is a section view taken along lines 25-25 in FIG. 23 depicting details of the housing attachment assembly depicted therein.

The key 164 is then axially rotated approximately 90 degrees into a second configuration as shown in FIGS. 23-25. In this second configuration, the limit portion 174*e* of the key 164 engages the attachment projection 162 at the key opening 172 as shown in FIGS. 24 to prevent further rotation of the key 164.

In addition, the clamp projections 174*d* engage the post 160 adjacent to the post opening 170 to prevent retraction of the key 164 from the openings 170 and 172 as shown in FIG. 25. The clamp projections 174*d* and/or the surface of the post 160 adjacent to the post opening 170 may be angled to impart a cam action at a juncture 176 between the projections 174*d* and the post 160 surface. This cam action serves to pull the housing parts 30*a* and 30*b* together.

Other attachment systems may be used to secure the housing parts 30*a* and 30*b* together. For example, the posts 160 can define an internal thread, while the key may be replaced with an externally threaded bolt adapted to mate with the internal thread on the post 160. The bolts are threaded onto the post to attach the housing parts 30*a* and 30*b* together.

Figure 29:
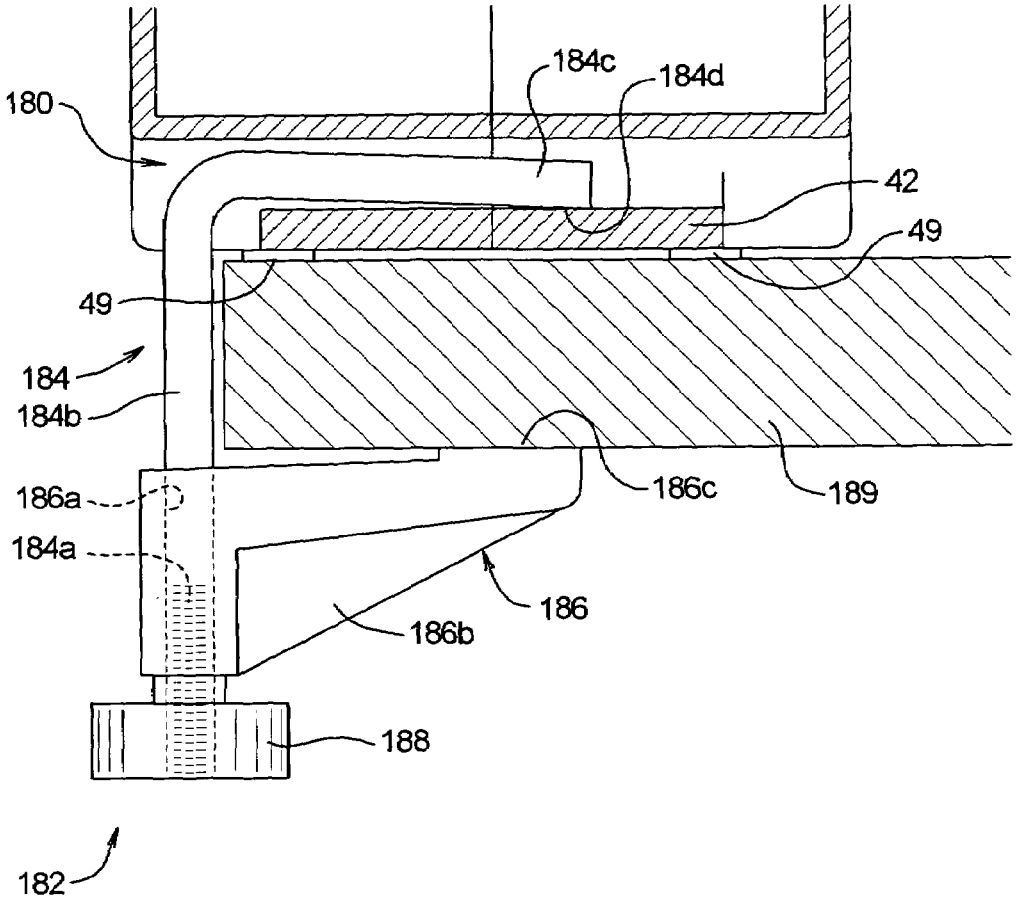
FIG. 29 is an elevation view depicting an optional mounting system that may be used in connection with the example roller press of FIG. 1.
Figure 30:
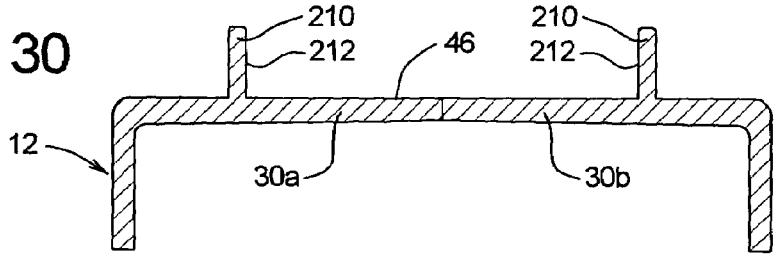
FIGS. 30-31 are cutaway views taken along lies 30-30 in FIG. 6 depicting a first output tray system that may be used by the roller press of FIG. 1.

Referring for a moment now to FIGS. 1 and 29, depicted therein is an optional base opening 180 that may be used to secure the housing 12 at a predetermined location on a structural member.

The example shown in FIG. 29 illustrates a clamp assembly 182 comprising a base member 184 having a threaded portion 184*a*, a brace member 186 defining a brace opening 186*a*, and an internally threaded nut member 188. The example base member 184 further defines a tension portion 184*b* and a clamp portion 184*c;* a clamp surface 184*d* is formed on the clamp portion 184*c*. As shown in FIG. 29, the example clamp portion 184*c* extends at an angle of slightly less than 90° from the tension portion 184*b*. The example brace member 186 comprises a web portion 186*b* that reinforces the brace member 186 between the brace opening 186*a* and a contact surface 186*c*.

To form the clamp assembly 182, the tension portion 184*b* of the base member 184 is passed through the brace opening 186*a*. The nut member 188 is threaded onto the threaded portion 184*a* of the base portion 184. In use, the base portion 184 is inserted into the base opening 180, and the brace member 186 is arranged underneath a structural member 189 such as a table or the like. Rotating the nut member 188 causes the nut member 188 to force the brace member 186 towards an engaging portion 184*a* of the base portion 184, thereby clamping the structural member 189.

The clamping force applied by the nut member 188 causes the base member 184 to deform slightly such that the clamp portion 184*c* thereof extends at a substantially right angle relative to the tension portion 184*b*. The base member 184 is made of a resilient material such as plastic such that deformation thereof creates a slight spring effect that enhances the clamping force applied by the base member 184 and the brace member 186.

Alternatively, magnetic, suction, adhesive, or other base assemblies that can engage the base opening 180 to limit movement of the housing 12 relative to the table 189 or other structural surface may be used.

Figure 34:
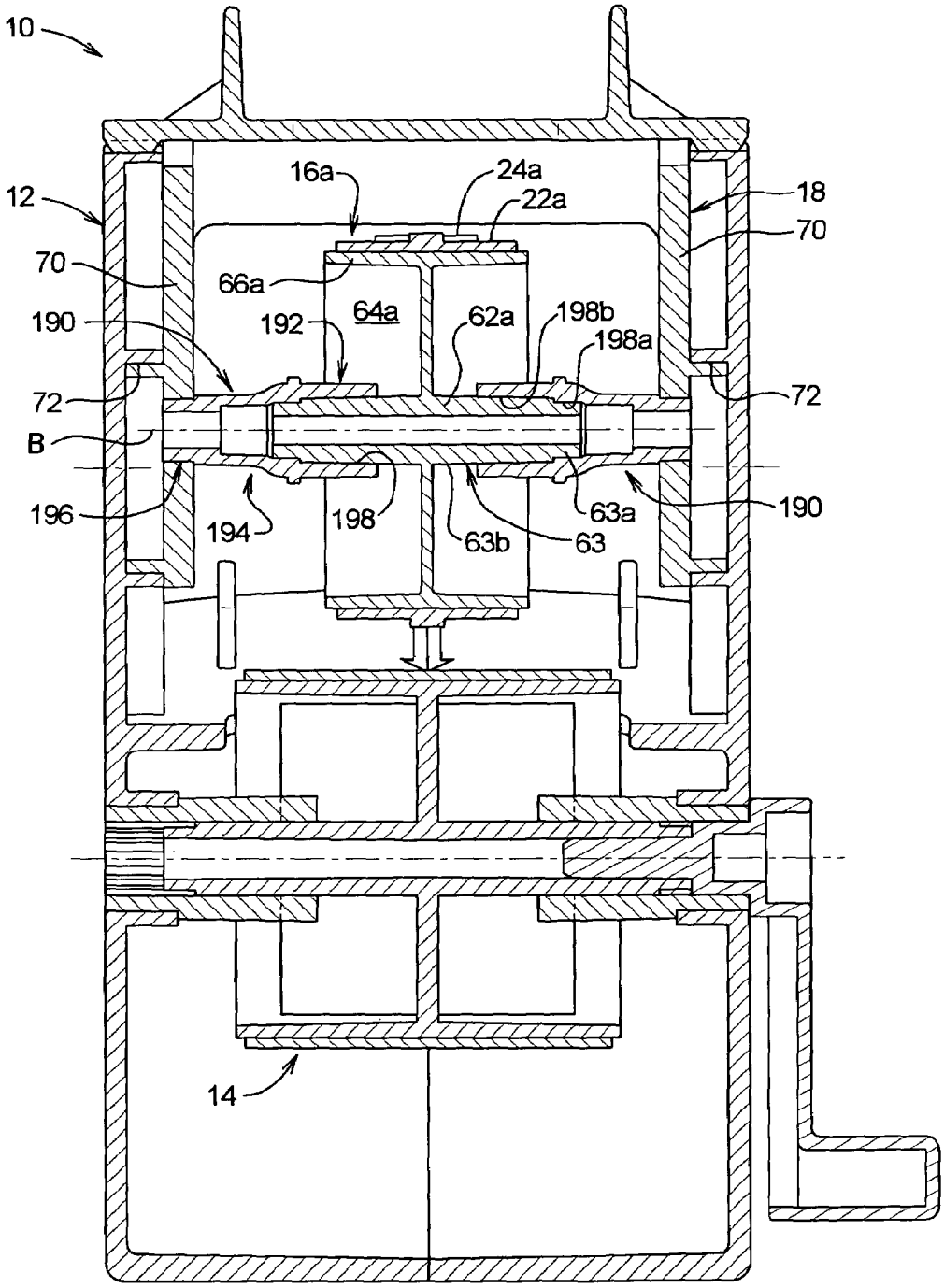
FIG. 34 is a front elevation sectional view taken along lines 9-9 in FIG. 6 depicting the use of an alternative upper roller.

Turning now to FIG. 34, the roller press system 10 is depicted therein in an alternate configuration. The roller press system 10 in this alternate configuration differs from the configuration depicted in FIGS. 1-18 in that the second roller 16 is replaced with a second roller 16*a* of smaller size. The roller 16*a* is in most respects the same as the roller 16 described above, and the same reference characters augmented with the suffice "a" will be used. The roller 16*a* will be described in detail herein only to the extent that it differs from the roller 16.

The roller 16*a* has the same diameter as the roller 16 but is shorter along the axis B. Accordingly, spacing bushings 190 are used to allow the shorter roller 16*a* to be supported by the example housing 12. In particular, the spacing bushings 190 have an inner portion 192, an intermediate portion 194, and an outer portion 196. The outer portion 196 is adapted to be received by the axle notches 72 in the standoff portions 70 of the carriage 18. The inner portions 192 defines adapter cavities 198 each comprising a first portion 198*a* that is adapted to receive the reduced diameter portions 63*a* of the axle 62*a* of the roller 16*a*. A second portion 198*b* of the adapter cavities 198 extends over the shaft surface 63*b* to strengthen the connection between the axle 62*a* and the spacing bushings 190. The intermediate portion 194 is sized and dimensioned to locate the roller 16*a* in a proper orientation with respect to the first roller 14. In the example of FIG. 34, the bushings 190 are identical, and the second roller 16*a* is centrally located above the first roller 14.

FIGS. 30-33 depict two different configurations of the infeed surface 46 of the housing 12. In the first configuration depicted in FIGS. 30 and 31, guide projections 210 are integrally formed with the housing members 30*a* and 30*b*. The guide projections 210 define opposing first guide surfaces 212 that guide the material to be processed between the first and second rollers 14 and 16. The guide projections 210 are located such that a distance between the opposing first guide surfaces 212 substantially matches a length of the first and second rollers 14 and 16.

Figure 31:
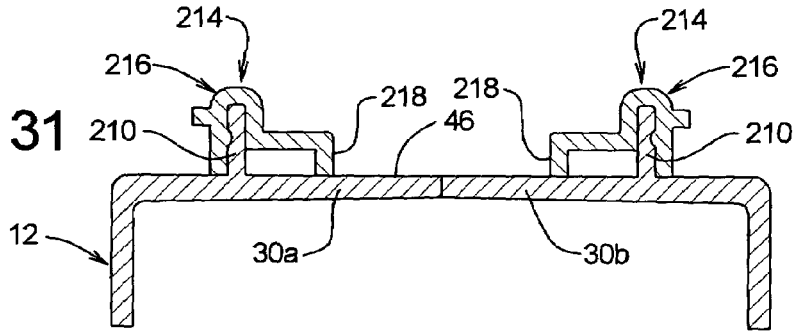

In a situation where a smaller roller such as the roller 16*a* described above is used, the guide surfaces 212 may be spaced too far apart. In this case, guide adapters 214 as depicted in FIG. 31 may be employed. The guide adapters 214 comprise securing portions 216 that are adapted to be press fit onto the guide projections 210. The guide adapters further define opposing second guide surfaces 218 that, when the guide adapters 214 are properly attached to the guide projections 210, are spaced closer together than the first guide surfaces 212.

Figure 32:
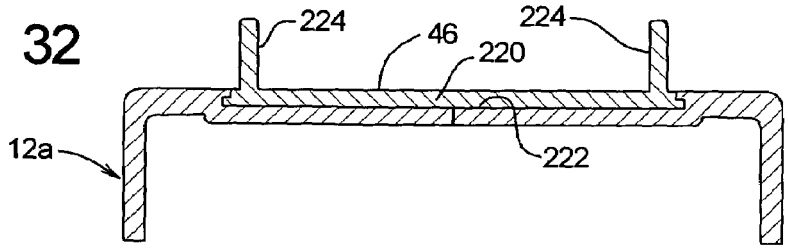
FIGS. 32-33 are cutaway views taken along lines 30-30 in FIG. 6 depicting an alternative output tray system that may be used by the roller press of FIG. 1.
Figure 33:
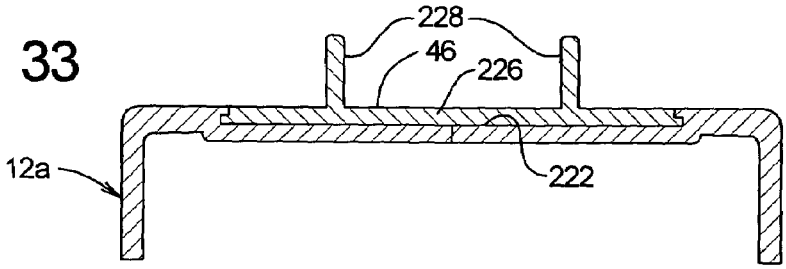

An alternative guide system is depicted in FIGS. 32 and 33. In this case, the guide projections are not integrally formed with the housing or components thereof. Instead, a separate first guide member 220 is provided, and a housing 12*a* that may in all other respects be the same as the housing 12 is provided with a guide channel 222. The guide channel 222 is sized and dimensioned to receive a portion of the first guide member 220 such that the guide member 220 is attached to the housing 12*a* and defines at least a portion of the infeed surface 46. First guide projections 224 extend from the first guide member 220 to guide the material being process between the rollers 14 and 16.

FIG. 33 illustrates that the first guide member 220 may be replaced with a second guide member 226. The second guide member 226 is also secured to the housing 12*a* by the guide channel 222. The guide member 226 defines a pair of second guide projections 228 that are spaced from each other a distance closer than the first guide projections 224.

Figure 35:
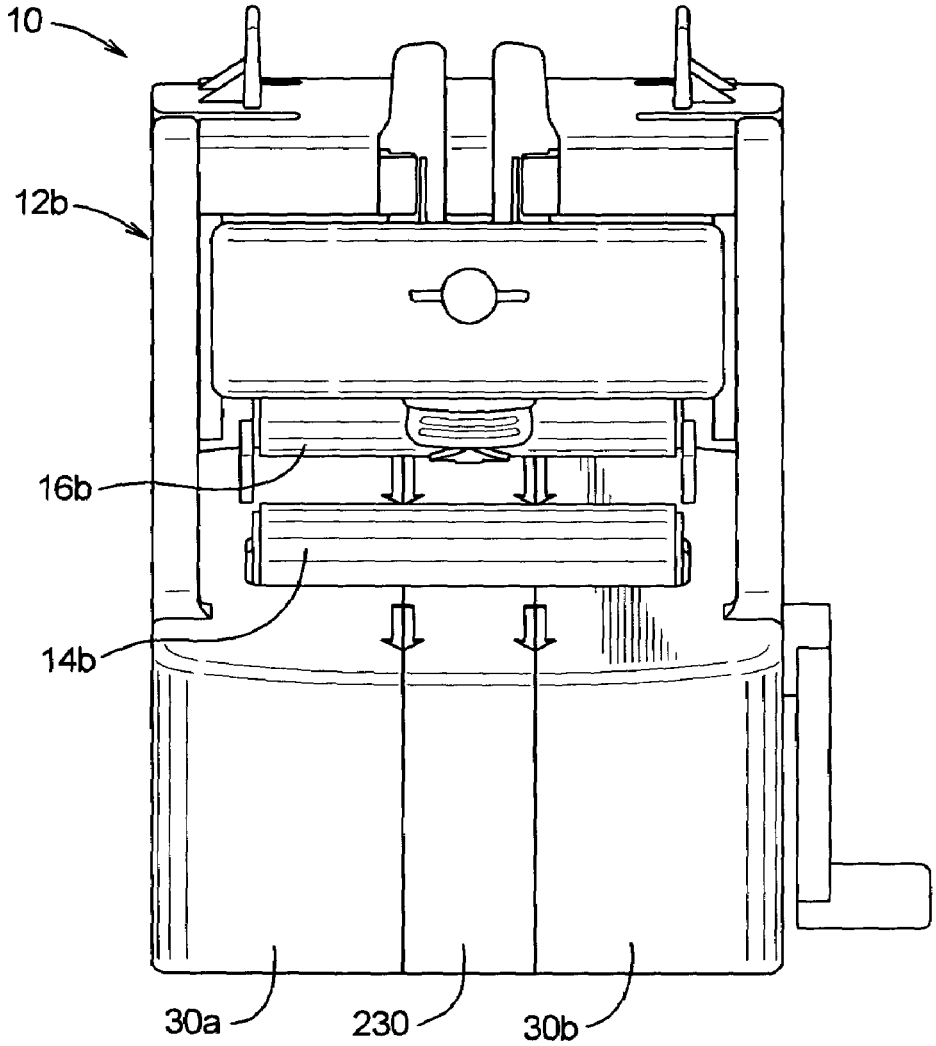
FIG. 35 is an elevation view depicting an alternative spacing member that may be used to enlarge the housing assembly of the example roller press depicted in FIG. 1.
Figure 36:
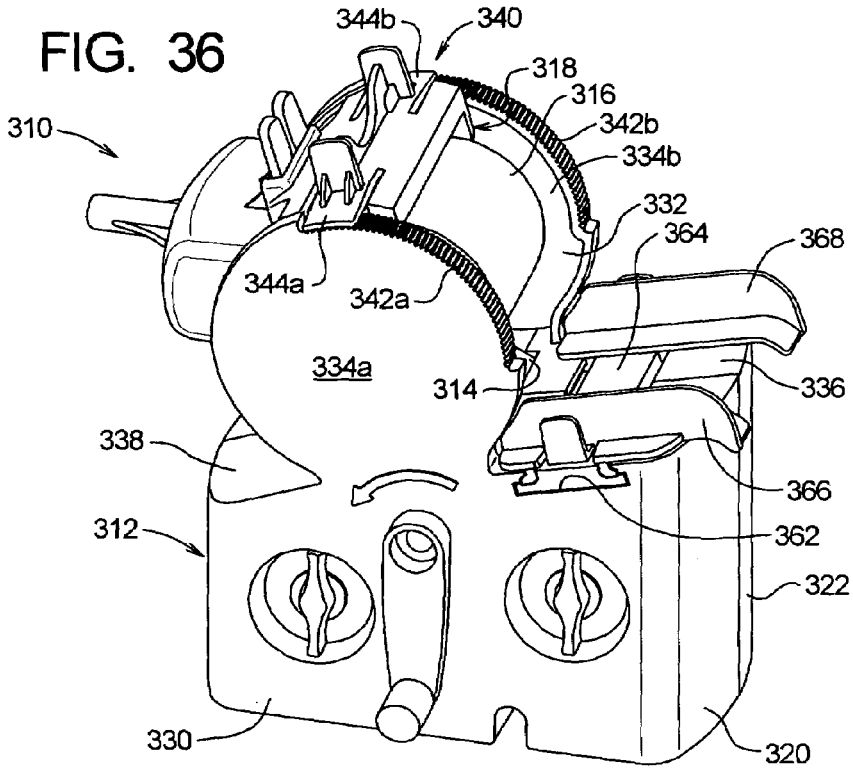
FIG. 36 is a perspective view of yet another example roller press system of the present invention.
Figure 37:
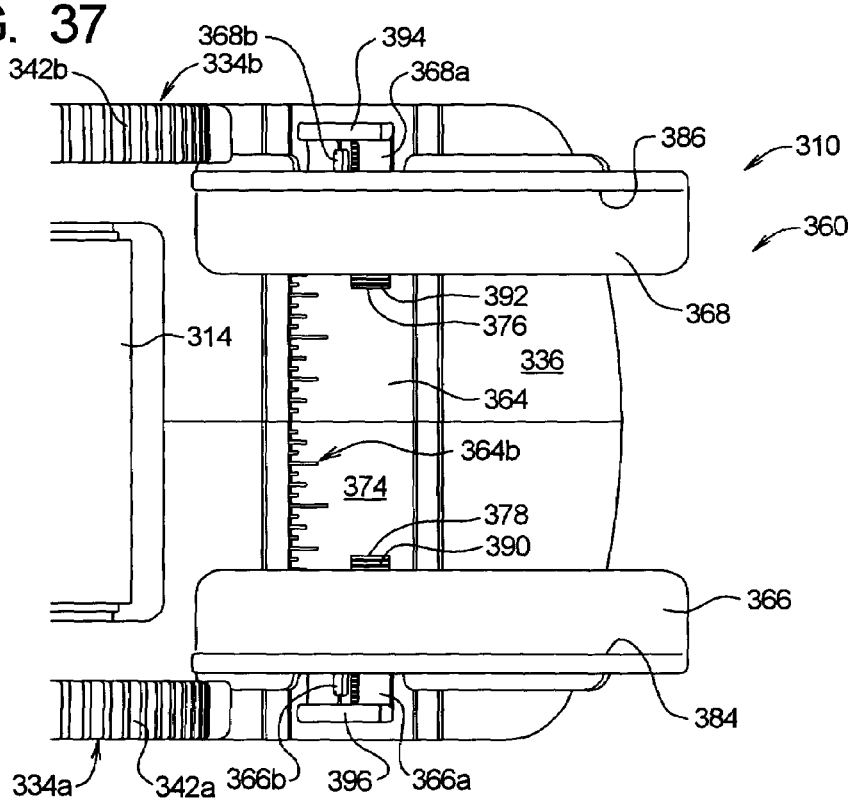
FIGS. 37 and 38 are top plan views of an infeed system of the roller press system of FIG. 36.

Referring now to FIG. 35, depicted therein is the roller press system 10 employing yet another housing 12*b*. The housing 12*b* is in most respects similar to the housing 12 described above but employs an adapter member 230. The adapter member 230 is arranged between the first and second housing members 30*a* and 30*b* to allow the housing 12 to accommodate first and second rollers 14*b* and 16*b* that are longer than the rollers 14 and 16 described above.

Referring now to FIGS. 36-49 of the drawing, depicted at 310 therein is yet another example roller press system Of the present invention. The roller press system 310 creates processed material from unprocessed material and is constructed and operates in a manner that is generally similar to that of the roller press system 10 described above. The roller press system 310 will be described below primarily to the extent that it differs from the roller press system 10 described above. The example roller process system 310 also forms a material processing system for arts and crafts materials.

The roller press system 310 comprises a housing 312, a first roller 314, and a second roller 316. As shown in FIG. 44-49, the first roller 314 is supported by the housing 312 for axial rotation about a first axis D, while the second roller 316 is supported for axial rotation about a second axis E relative to a carriage 318. The carriage 318 is in turn supported by the housing 312 for pivotal rotation about a third, or carriage, axis F. As with the roller press system 10 described above, the first, second, and third axes, D, E, and F are parallel to each other.

The example housing 312 comprises a pair of matched housing members 320 and 322 and defines side walls 330 and 332. Carriage supports 334*a* and 334*b* extend from the side walls 330*a* and 330*b*, respectively. An infeed surface 336 supports the unprocessed material, and an outfeed surface 338 supports the processed material.

Figure 46:
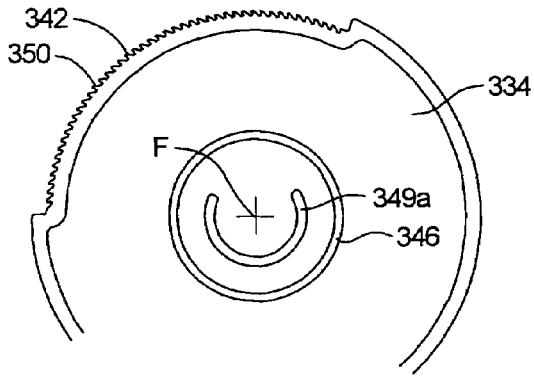
FIG. 46 is a side elevation view depicting a carriage support of the roller press system of FIG. 36.
Figure 47:
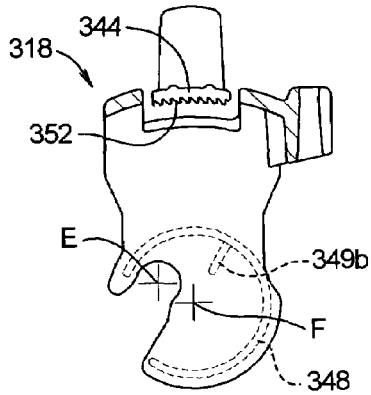
FIG. 47 is a side elevation, section view depicting a portion of a carriage forming part of the carriage system of FIGS. 44 and 45.

The carriage 318 is attached to the housing 312 using a carriage mounting system 340. The example mounting system 340 comprises ratchet surfaces 342*a* and 342*b* formed on the carriage supports 334*a* and 334*b*, respectively, and pawl portions 344*a* and 344*b* formed on the carriage 318. In addition, FIGS. 46 and 47 show that the carriage support mounting system 340 further comprises carriage support portions 346 are formed on the carriage supports 334, while carriage pivot portions 348 are formed on the carriage 318.

The carriage support portions 346 are circular walls extending from opposing surfaces of the carriage supports 334*a* and 334*b*. The carriage pivot portions 348 are walls that extend from outwardly facing surfaces of the carriage 318. As perhaps best shown in FIGS. 48 and 49, the carriage support portions 346 and the carriage pivot portions 348 are centered about the axis F defined above and engage each other to allow the carriage 18 to pivot relative to the housing 12. As shown in FIGS. 46-49, a first key wall 349*a* and second key wall 349*b* formed on the housing 312 and carriage 318.

Figure 44:
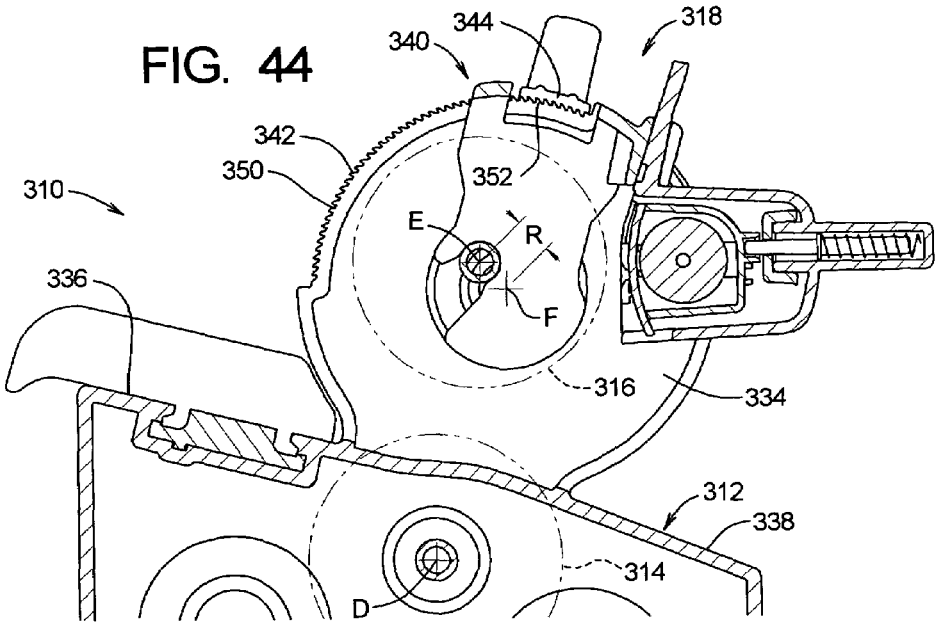
FIGS. 44 and 45 are side elevation views depicting the construction and operation of an example carriage system of the roller press system depicted in FIG. 36.
Figure 45:
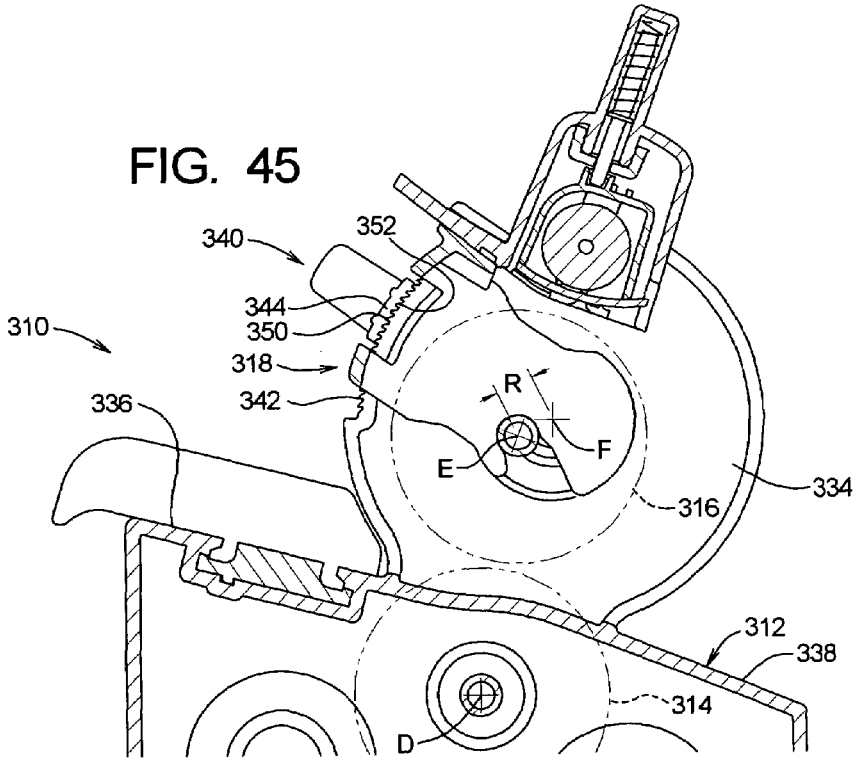
Figure 48:
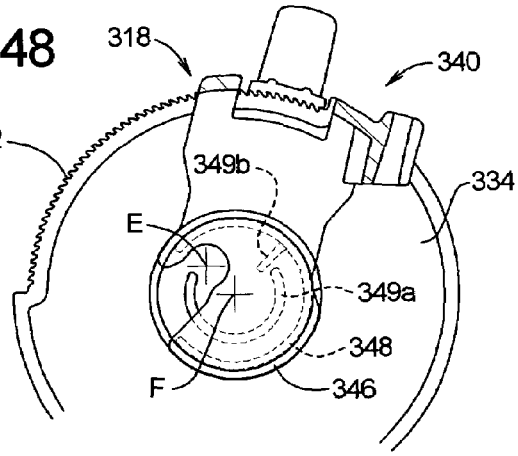
FIGS. 48 and 49 are side elevation views illustrating the interaction of the carriage support and carriage depicted in FIGS. 46 and 47.
Figure 49:
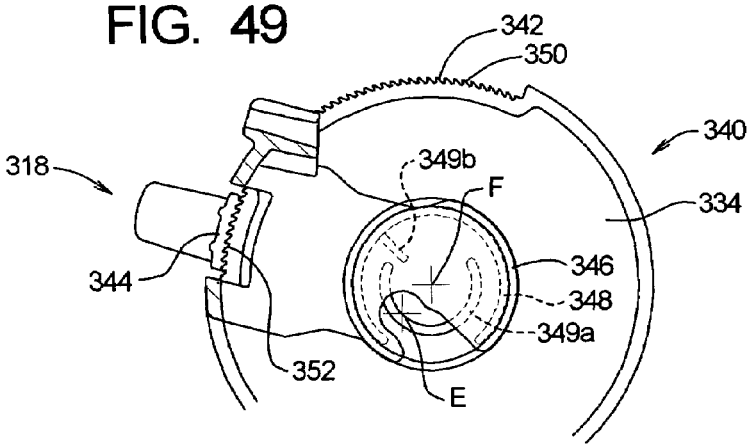

FIGS. 44 and 45 show that the carriage 318 rotates about the carriage axis F such that the second roller 316 moves within a continuum of positions between a first position shown in FIG. 48 and a second position shown in FIG. 49. The key walls 349*a* and 349*b* interact to ensure proper mounting of the carriage 318 on the housing 312 and to limit the movement of the carriage 318 between the first and second positions as described above.

In the first position, the second roller 316 is spaced a first predetermined distance from the first roller 314. When the carriage 318 is in the second position, the second roller 316 is in contact with the first roller. In addition, the second roller 316 may be placed in any one of a number of spaced locations relative to the first roller 314 by arranging the carriage 318 in one of a plurality of intermediate positions between the first and second positions.

In the example roller press system 310, the first and second rollers 314 and 316 have the same diameter. In addition, the second roller axis E is spaced a spacing distance S from the carriage axis F. The first and second roller axes D and E are spaced from each other a distance less than the sum of the diameter of the first rollers 314, the diameter of the second roller 316, and the rotation distance R. The arrangement of the various axes D, E, and F and diameters of the rollers 314 and 316 of the example roller press system 310 thus allow the second roller 316 to move towards and away from the first roller 314.

The distance between the second roller 316 and the first roller 314 can be important during use of the roller press system of the present invention. For example, one use of the roller press system of the present invention is to apply ink to paper. Paper comes in different grades and thicknesses. To allow a clean, complete transfer of ink from the second roller 316 to the paper, the second roller 316 must be spaced properly relative to the first roller 314 given the grade and thickness of the paper. As other examples, die cutting and/or other material processing uses of the roller press system 310 may require precise control of the distance between the first and second rollers 314 and 316.

One option for controlling the distance between the rollers 314 and 316 is to allow the carriage 318 to be fixed anywhere along the continuum between the first and second positions described above. When transferring ink to paper, the carriage 318 is rotated to and fixed at the point on this continuum as necessary to obtain clean, complete transfer of ink from the second roller to paper. A separate clamping system would be required to fix the location of the carriage 318 relative to the housing 312.

The example roller press system 310, however, uses the carriage mounting system 340 comprising the ratchet surfaces 342 and pawl portions 344 described above. As generally described above, the ratchet surfaces 342 define ratchet teeth 350, and the pawl portions 344 define pawl teeth 352 sized and dimensioned to engage the ratchet teeth 350.

The mounting system 340 allows the carriage 318 to be secured relative to the housing 312 at any one of a plurality of discrete locations along the ratchet surfaces 342 between the first and second positions. The location of the carriage 318 relative to the housing 312 determines a roller spacing between the rollers 314 and 316. A ratchet distance between each of a plurality of ratchet teeth 350 along the ratchet surfaces 342 thus determines how a roller distance corresponding to the incremental distance that the second roller 316 travels towards the first roller 314.

In the example system 310, the relationship between the ratchet distance and the roller distance is non-linear. In particular, the ratchet distance is the same along the entire ratchet surface 342. However, the axes D, E, and F are arranged such that the roller distance is relatively large when the carriage 318 is in the first position and becomes smaller as the carriage 318 approaches the second position.

By appropriately choosing the relationships among the axes D, E, and F and the ratchet distance, the carriage mounting system 340 can be designed to provide very fine control of the roller spacing between the rollers 314 and 316, especially when these rollers 314 and 316 are closest to each other. In the example carriage mounting system 340, the ratchet distance is noticeably smaller (more ratchet teeth 350 per linear inch) than the similar parameter of the carriage mounting system 50 described above. The carriage mounting system 340 thus allows finer control of the roller spacing between the rollers 314 and 316 than the carriage mounting system 50 described above.

Referring now to FIGS. 37-43 of the drawing, depicted at 360 is an adjustable infeed system that may be used by the roller press system 310. The infeed system 360 comprises a mounting recess 362 formed in the infeed surface 336 of the housing 312, a mounting plate 364, and first and second guide members 366 and 368. The mounting plate 364 is arranged in the mounting recess 362 to define first and second rail grooves 370 and 372 in the infeed surface 336. The mounting plate 364 further defines an upper surface 374 on which is formed first and second groups 376 and 378 of notches.

Figure 41:
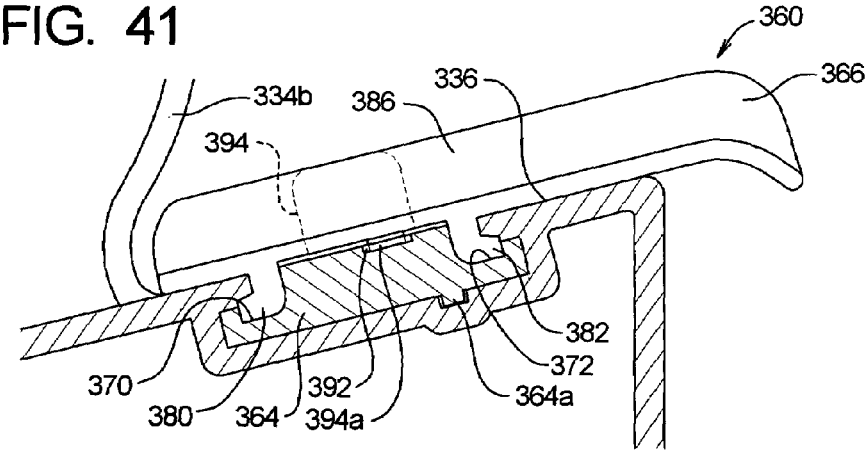
FIG. 41 is a side elevation, cutaway view of the infeed system depicted in FIGS. 37-40.

The mounting plate 364 may be glued, pinned, or otherwise secured to the housing 312 to prevent relative movement between the plate 364 and housing 312. The example mounting plate 364 is secured by an integrally formed pin 364*a* that, as shown in FIG. 41, engages a cavity in mounting recess 362 of the housing 312. The mounting plate 364 facilitates assembly of the example system 310, but other structures may be used to movably mount the guide members 366 and 368 onto the housing 312.

Figure 38:
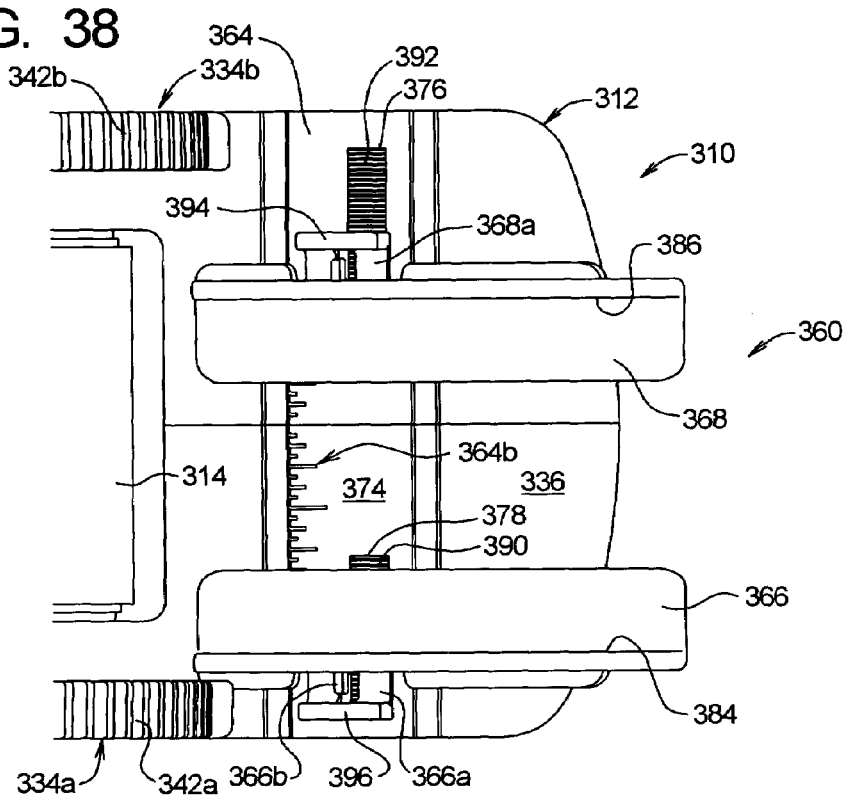
Figure 39:
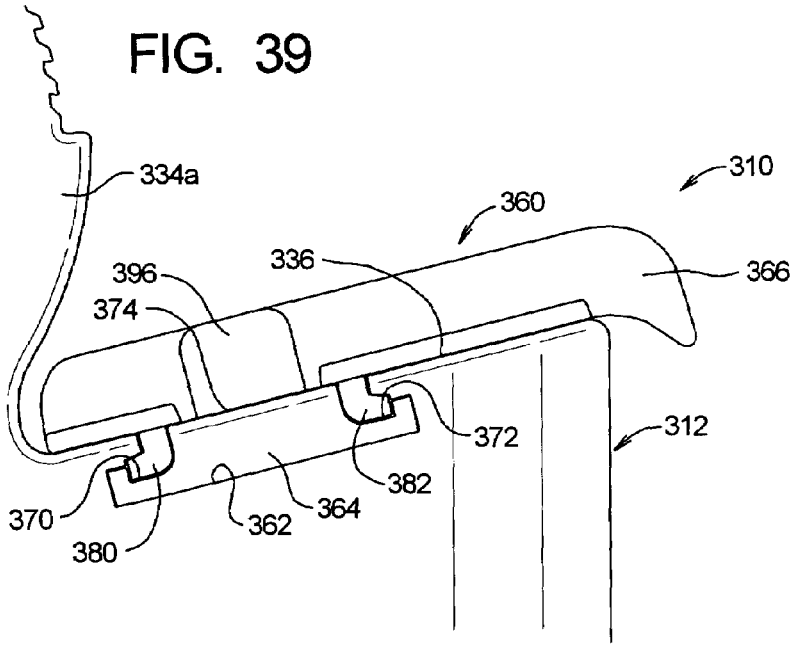
FIG. 39 is a side elevation view of the infeed system depicted in FIGS. 37 and 38.
Figure 40:
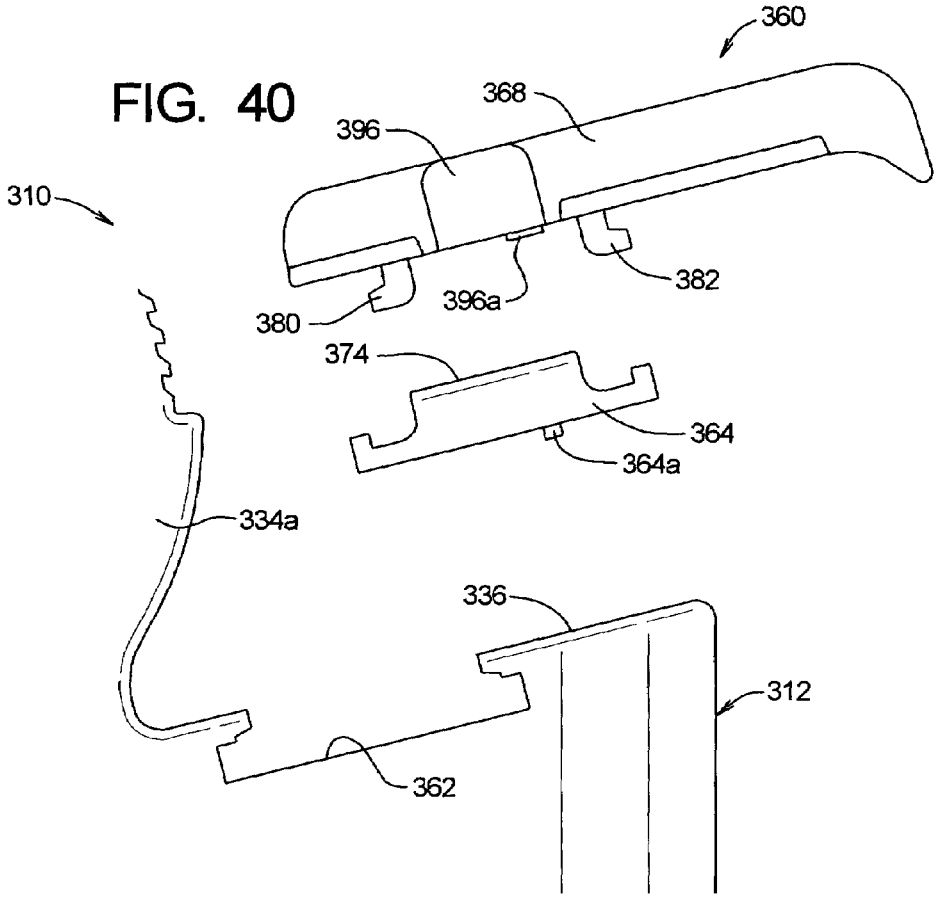
FIG. 40 is a side elevation, exploded view of the infeed system depicted in FIGS. 37-39.

The guide members 366 and 368 each define a pair of guide legs 380 and 382. The guide legs 380 and 382 extend into the rail grooves 370 and 372. The guide legs 380 and 382 fit into the grooves such that the guide rail members 366 and 368 can only be moved laterally relative to to the housing 312. So mounted to the housing 312, the guide rail members 366 and 368 may be moved towards and away from each other between inner and outer positions as generally shown in FIG. 38. In FIG. 38, the first guide member 366 is shown in the outer position, while the second guide member 368 is shown in the inner position.

The guide rail members 366 and 368 define guide rail surfaces 384 and 386 are aligned with the direction in which the unprocessed material is fed between the rollers 314 and 316. The guide rail members 366 and 368 thus can be located as necessary for a particular size and shape of unprocessed material such that the rail surfaces 384 and 386 guide the unprocessed material between the rollers 314 and 316 during operation of the system 310.

Figure 42:
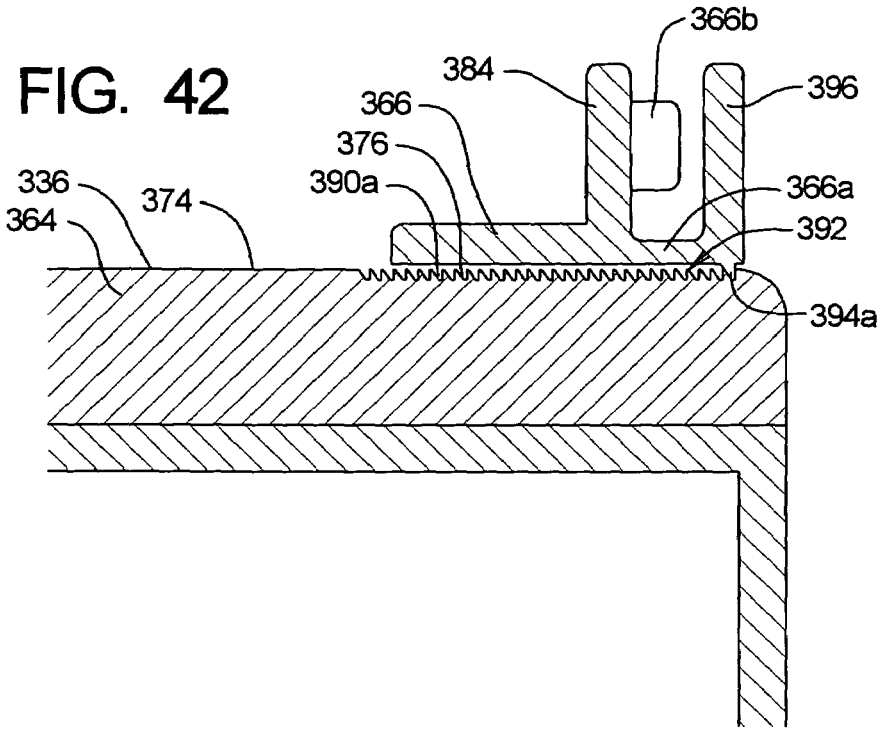
FIGS. 42 and 43 are close up, cutaway views depicting a locking portion of the infeed system depicted in FIGS. 37-41.
Figure 43:
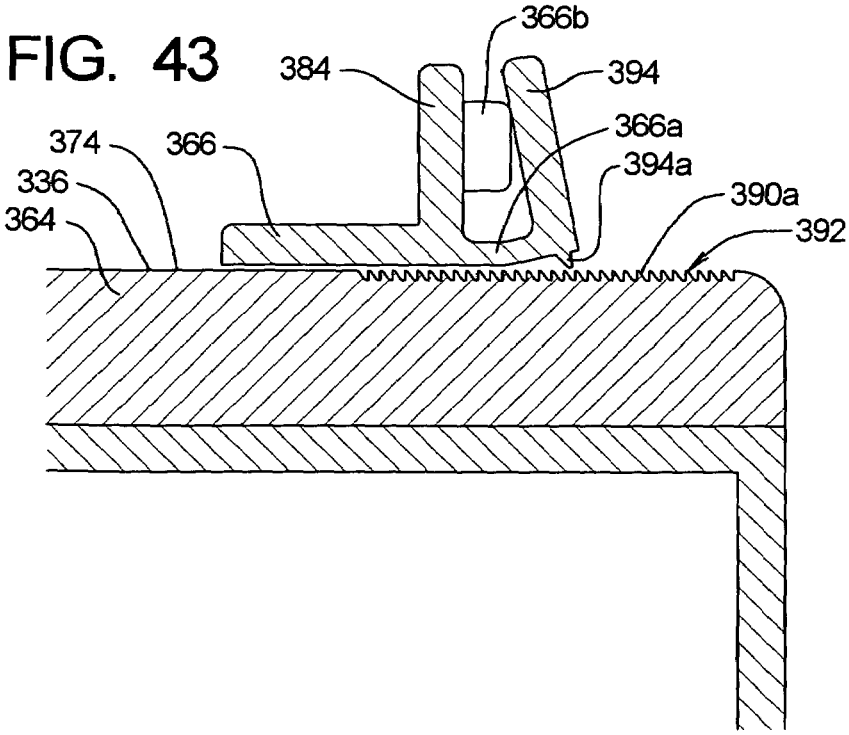

An example system for fixing the guide rail members 366 and 368 at desired positions relative to the housing 312 is shown in FIGS. 38, 42, and 43. In particular, first and second locking surface portions 390 and 392, which are fixed relative to the housing 312, are provided. In the example system 310, these surface portions 390 and 392 are formed on the mounting plate 364. First and second locking tabs 394 and 396 are formed on the guide members 366 and 368.

In particular, the example locking tabs 394 and 396 are connected to the guide members 366 and 368 by tab extensions 366*a* and 368*a*. The tab extensions 366*a* and 368*a* are formed of material that, in proper shape and thickness, may be deformed slightly to allow the locking tabs 394 and 396 to be moved between a locked position (FIG. 42) and an unlocked position (FIG. 43).

The interaction of the example locking tab 394 and the corresponding locking surface portion 390 is perhaps best shown in FIGS. 37, 38, 42, and 43. The locking surface portion 390 is formed by a plurality of narrow grooves 390*a* formed in the mounting plate 364. The locking tab 394 defines a locking projection 394*a*.

In the locked position, the locking projection 394*a* engages a selected one of the locking grooves 390*a* when the guide surface 384 is arranged at a desired location. The engagement of the locking projection 394*a* with one of the locking grooves 390*a* inhibits relative movement between the guide member 366 relative to the mounting plate 364 and thus the housing 312. In the unlocked position, the locking projection 394*a* is disengaged from any of the grooves 390*a*, allowing the guide member 366 to be moved to any desired position between the inner and outer positions.

Indicia 364*b* (FIGS. 37 and 38) are formed on the portion of the mounting plate 364 defining the infeed surface 336. The indicia 364*b* may take the form of a scale or the like that facilitates placement of the guide members 366 and 368 at desired locations. Similar indicia may be formed instead or in addition on the portion of the infeed surface 336 defined by the housing 312.

FIGS. 37, 38, 42, and 43 further illustrate stop projections 366*b* and 368*b* extending from the guide members 366 and 368. FIG. 43 illustrates that the stop projections 366*b* and 368*b* prevent excessive movement of the locking tabs 394 and 396 that might otherwise damage the tab extensions 366*a* and 368*a*.

Figure 50:
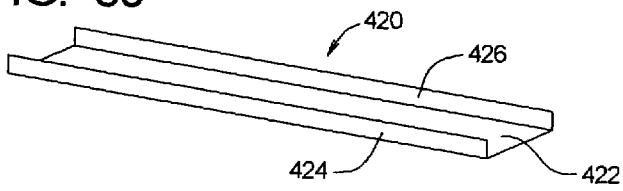
FIG. 50 is a perspective view depicting an example material tray that may be used by any of the roller press systems of the present invention.
Figure 51:
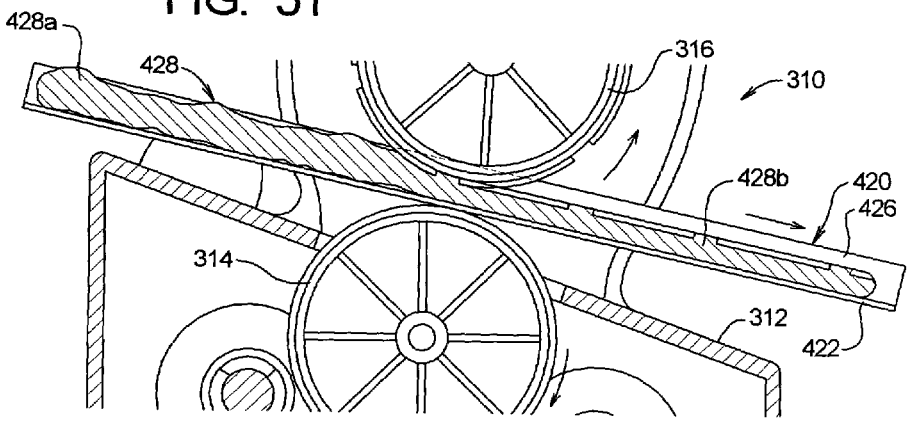
FIG. 51 is a partial, side elevation, section view depicting the material tray of FIG. 50 being used by the example roller press system depicted in FIG. 36.

Turning now to FIGS. 50 and 51, illustrated therein is a material tray 420 that may be used with a roller press system of the present invention. As shown in FIG. 50, the example material tray 420 comprises a bottom wall 422 and first and second side walls 424 and 426. Material 428 in an unprocessed form 428*a* is placed on the bottom wall 422. Modeling clay or the like would commonly be used as the material 428, but any material that can be formed as shown in FIGS. 50 and 51 may be used.

As shown in FIG. 51, the combination of the tray 420 and unprocessed material 428*a* is passed through the roller press system 310 to obtain processed material 428*b*. The tray 420 is made of or coated with a material that adheres lightly to the material 428 so that the processed material 428*b* stays with the tray 420 after processing. The tray 420 thus prevents the processed material 428*b* from adhering to and following the second roller 316 up into the housing 312.

Once material 428 has been completely processed, the combination of the tray 420 and the processed material 428*b* is passed out of the housing 312. The processed material 428*b* may then be removed from the tray 420 for use.

The bond between the tray 420 and the material 428 must thus be strong enough to prevent the processed material 428*b* from following the second roller 316 after processing. This bond must, however, be sufficiently weak to allow the processed material 428*b* to be removed from the tray 420 without disrupting the form or structure of the processed material 428*b* as formed by the roller press system 310.

Alternatively, the processed material 428*b* may be further processed. For example, some clay materials harden when subjected to heat. If the processed material 428*b* is oven hardenable clay, the tray 420 may be made of a heat resistant material that can support the processed material 428*b* when the process material is further heat processed by, for example, being placed in an oven. In this case, the tray 420 may be made of any material that can withstand the heat required to harden the unprocessed material 428*b*, but a class of materials often referred to as "ovenable" paper may be used. Such materials are often used to store, cook, and serve pre-prepared foods such as frozen pizzas and the like.

The example tray 420 may thus be made of coated cardboard, ovenable papers, or other materials that provide an appropriate mix of adhesion/release and post processing (e.g., heat resistance) characteristics.

Figure 52:
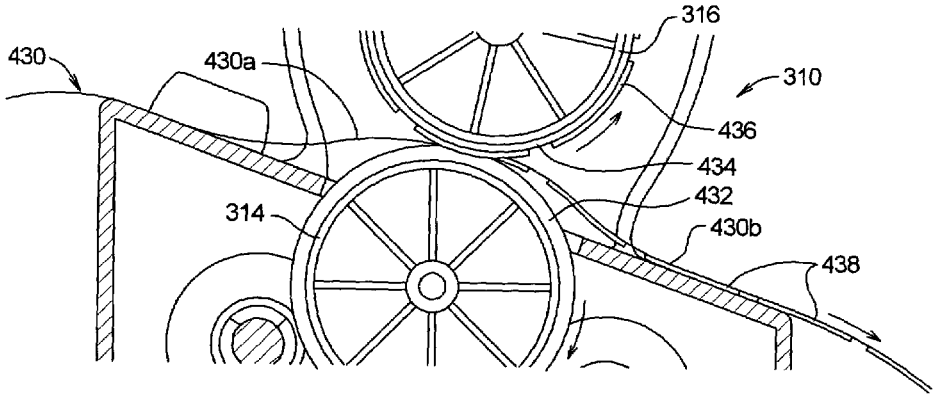
FIG. 52 is a partial side elevation, sectional view depicting the example roller system being used to emboss a material.

Referring now to FIG. 52, depicted therein is the texturing system 310 modified to emboss a material 430. The material 430 is shown in an unprocessed form at 430*a* and in a processed, or embossed, form at 430*b*. The first wheel 314 is covered by a receiving material 432, while the second wheel 316 is covered by an embossing material 434. The embossing material 434 defines projections 436 in the form of one or more shapes to be embossed into the material 430.

The hardness of the receiving material 432 should be selected relative to the hardness of the embossing material 434 based on the nature of the material being processed. For some materials 430 being embossed, the receiving material 432 should be relatively soft, allowing the embossing material 434 to push the material 430 into the receiving material 432. For still other materials 430, providing a receiving material 432 having complimentary recesses aligned with the projections 436 on the embossing material may be appropriate.

For materials such as metal foil, the hardness of the receiving material 432 and embossing material 434 should similar if not the same. In this case, the embossing material 434 slightly creases the material 430 without substantially stretching or deforming the material 430. In the example shown in FIG. 52, the receiving material 432 and embossing material 434 are made of rubber suitable for ink stamping and have approximately the same durometer.

As the unprocessed material 430*a* passes between the rollers 314 and 316, the projections 436 of the embossing material 434 press the unprocessed material 430*a* against the receiving material 432. The projections 436 leave slight indentations 438 in the processed material 430*b* in the shape of the projections 436. The material 430 may take many forms, but foil and paper are commonly used materials that can take and hold the shape of the indentations 438.

Figure 53:
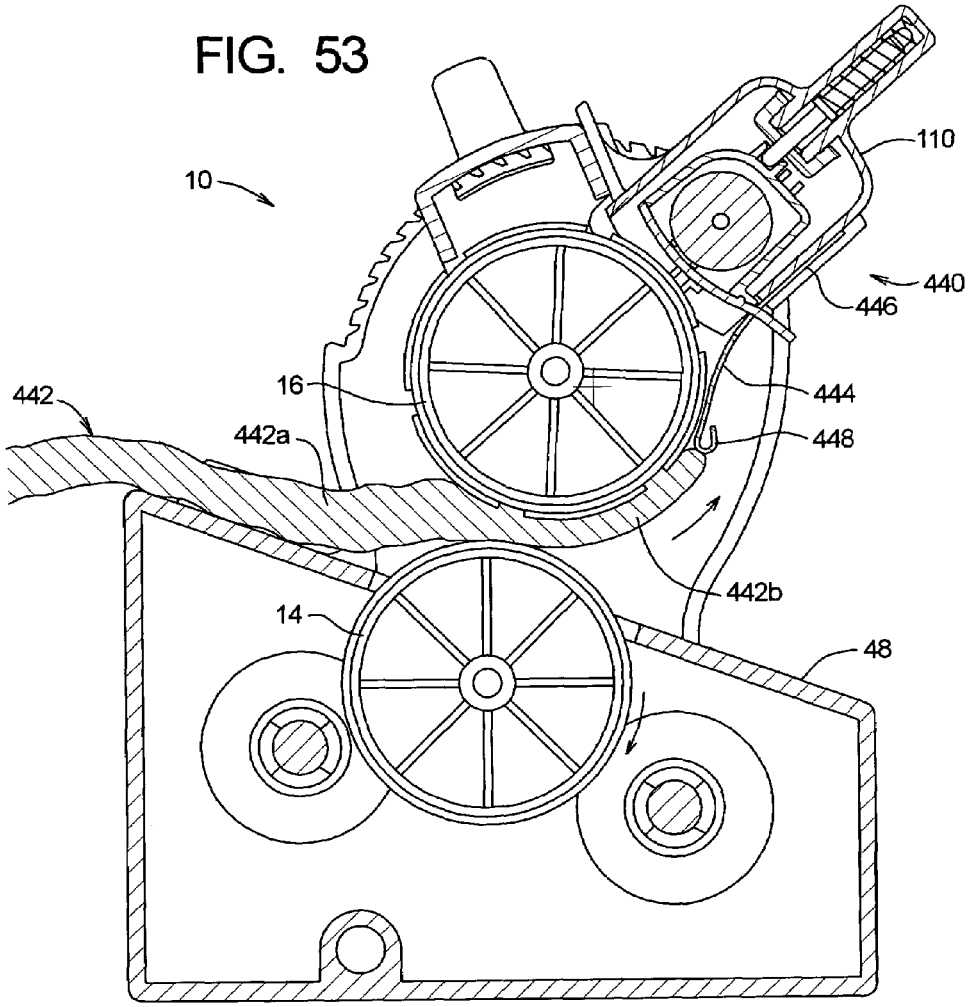
FIGS. 53 and 54 are side elevation, section views depicting the construction and operation of a scraper system by the example roller press system depicted in FIG. 1.
Figure 54:
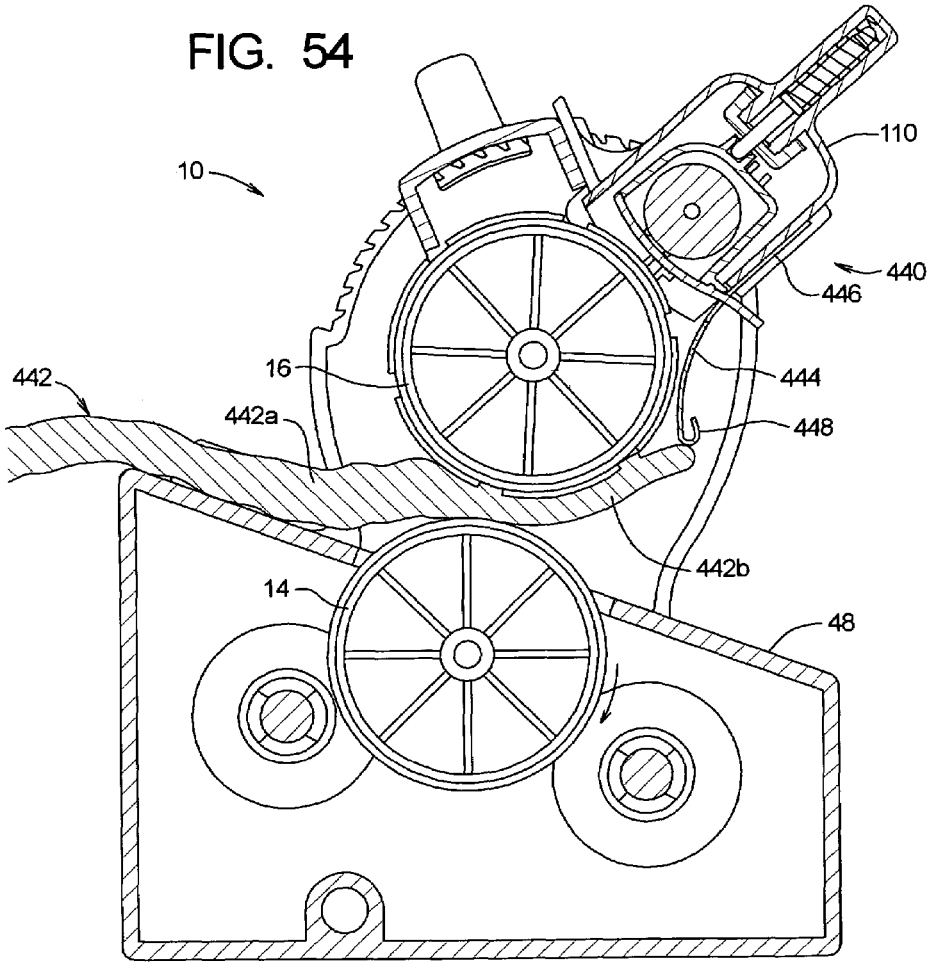

Referring now to FIGS. 53 and 54, depicted therein is the roller press system 10 described above modified to employ a scraper system 440. The roller press system 10 converts a material 442 from an unprocessed form 442*a* into a processed form 442*b*. The example scraper system 440 comprises a scraper member 444 that is attached to the auxiliary housing 110.

In particular, the scraper member 444 comprises a first end 446 adapted to be supported by the auxiliary housing and a second end 448. The second end 448 is configured to engage the processed material 442*b* to remove the processed material 442*b* from the second roller 16. The scraper member 444 is arranged to extend along the second roller 16 approximately 90° from the point where the rollers 14 and 16 are closest together.

As the processed material 442*b* leaves the point where the rollers 14 and 16 are closest together, the processed material 442*b* engages the second end 448 of the scraper member 444 as shown in FIG. 53. The scraper member 444 is made of a flexible, resilient material that deflects with continued movement of the processed material 442*b* to separate the processed material 442*b* from the second roller 16 as shown in FIG. 54.

As the system 10 continues to process the material 442, the weight of the processed material 442*b* causes the portion of the processed material 442*b* in contact with the scraper member 444 to fall away from the second wheel 16 and onto the outfeed surface 48. The second end 448 of the scraper member 444 thus only lightly and momentarily engages the second end of the processed material 442*b* and does not substantially deform the processed material 442*b*.

Figure 55:
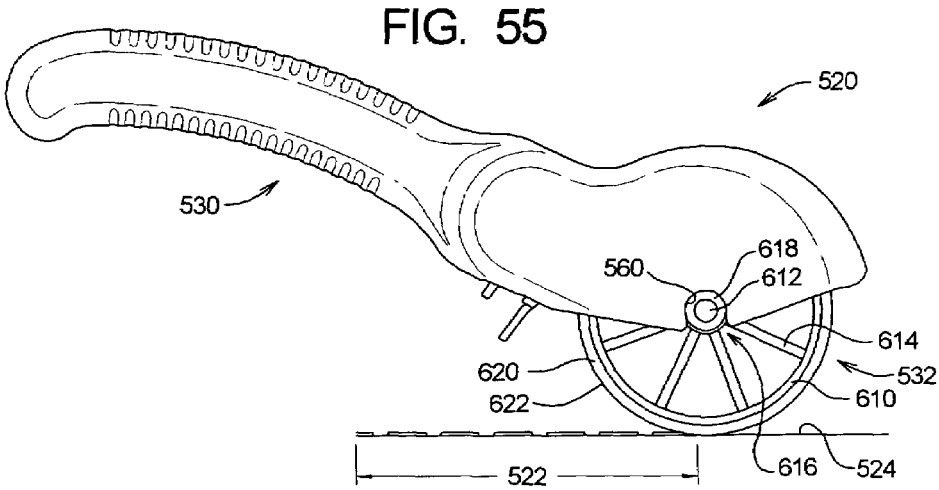
FIG. 55 is side elevation view depicting a material processing system of the present invention.
Figure 56:
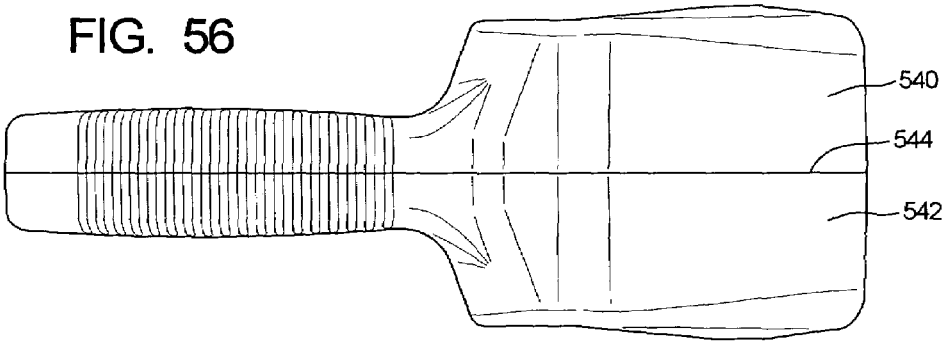
FIG. 56 is a top plan view of the material processing system of FIG. 55.

Referring now to FIG. 55, depicted at 520 therein is another example material processing system constructed in accordance with, and embodying, the principles of the present invention. The material processing system 520 is used in a conventional manner to form ink images 522 on a surface 524. The method of forming the ink images 522 is not per se a part of the present invention and will not be described herein. In the following discussion, the terms "rear" or "rearward" and "front" or "frontward" refer to directions towards the left and right, respectively, in FIGS. 55-60 and 61-63.

Figure 58:
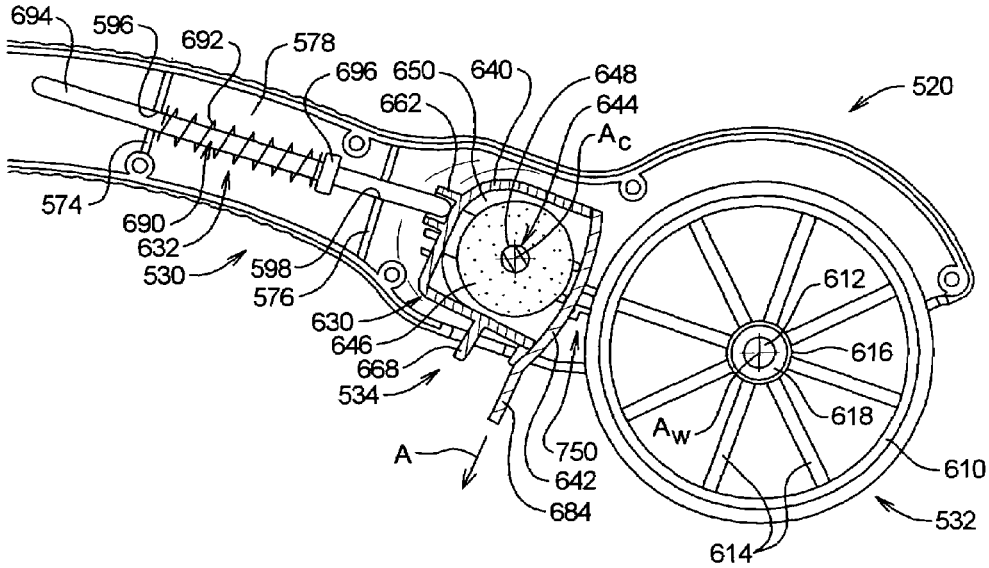
FIGS. 58 and 59 are a side elevation views of the material processing system of FIG. 55 with a portion of a handle assembly removed.

As perhaps best shown in FIG. 58, the material processing system 520 comprises a handle assembly 530, a stamp wheel assembly 532, and an inking system 534. The handle assembly 530 rotatably supports the stamp wheel assembly 532. The inking system 534 is mounted within the handle assembly 530 such that ink is applied to the stamp wheel assembly 532 as the stamp wheel assembly 532 rotates.

The handle assembly 530 comprises first and second handle portions 540 and 542. The example handle portions 540 and 542 are secured together along a parting line 544 (FIGS. 56 and 57) by a connecting system 546. The example connecting system 546 comprises cavities 548 that receive bosses (not shown) that are received in the cavities 548.

Figure 57:
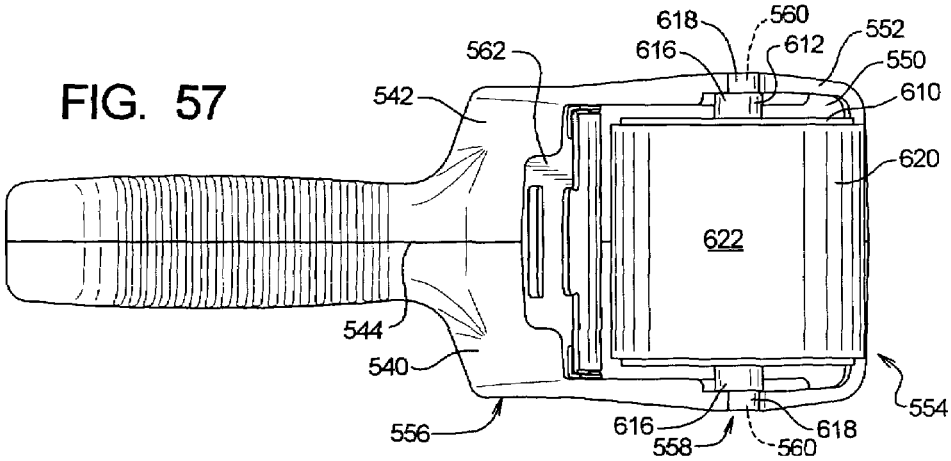
FIG. 57 is a bottom plan view of the material processing system of FIG. 55.
Figure 61:
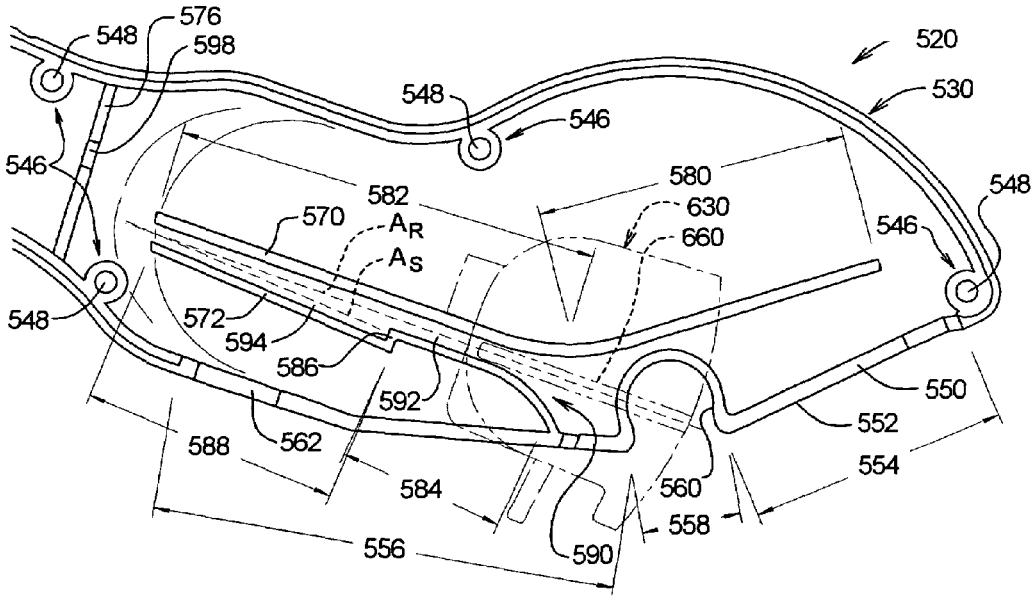
FIGS. 61-63 are side elevation views of a portion of a handle assembly of the present invention illustrating a cartridge assembly in insertion, engaging, and storage positions, respectively.

The handle assembly 530 defines a wheel opening 50 (FIG. 57) circumscribed by an opening edge 552 (FIGS. 57 and 61). The opening edge 552 comprises a front portion 544, a rear portion 546, and intermediate portions 58. The opening edge 552 further defines wheel notches 560 formed at the intermediate portions 58. A cartridge notch 562 is formed in the rear portion 546. As will be described in further detail below, the wheel notches 560 receive and support the stamp wheel assembly 532, while the cartridge notch 562 facilitates access to portions of the inking system 534.

As best shown in FIGS. 58 and 61, the handle portions 540 and 542 each define an upper guide wall 570, a lower guide wall 572, a stop wall 574, and a pin wall 576. When the handle portions 540 and 542 are joined together, a spring chamber 578 is formed between the stop wall 574 and the pin wall 576.

The upper guide wall 570 comprises an opening portion 580 and a channel portion 582. The lower guide wall 572 defines a funnel portion 584, a latch portion 586, and a rear portion 588. The channel portion 582 of the upper guide wall 570 and the funnel, latch, and rear portions 84-88 of the lower guide wall 572 define a cartridge channel 590. The cartridge channel 590 comprises an engaging portion 92 and a storage portion 94.

Figure 62:
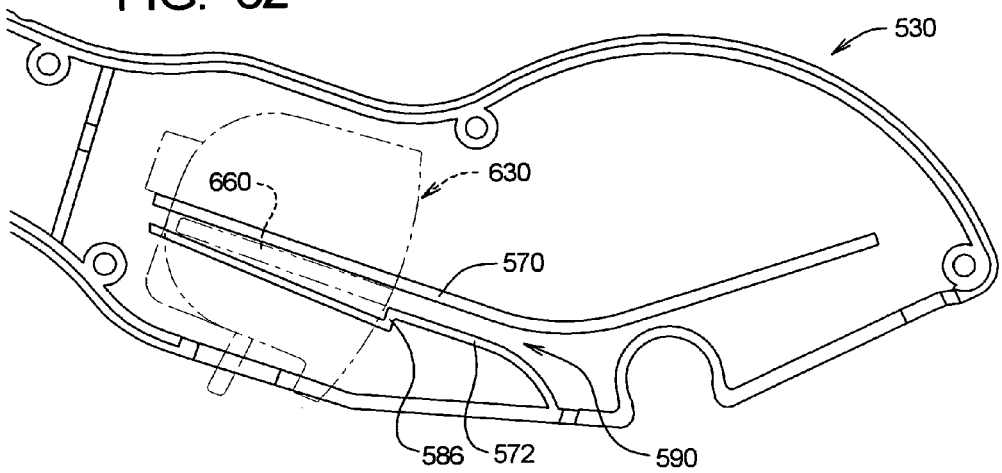
Figure 63:
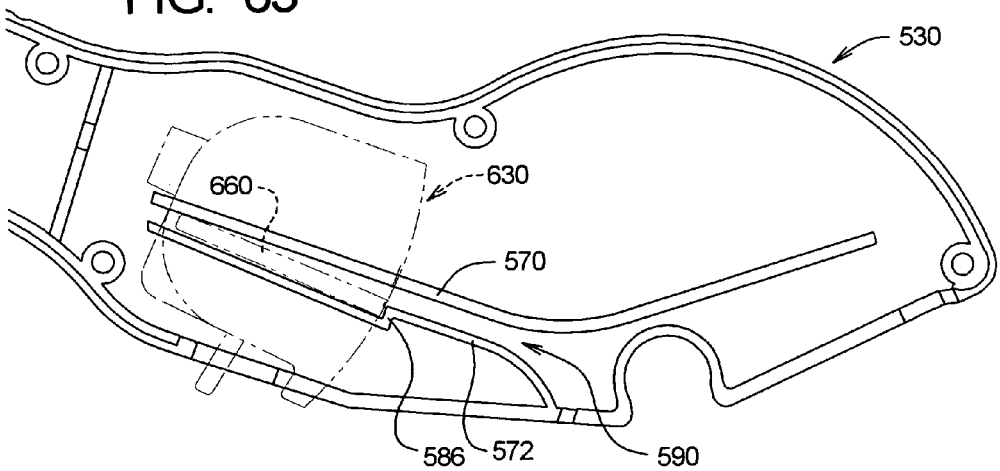
Figure 64:
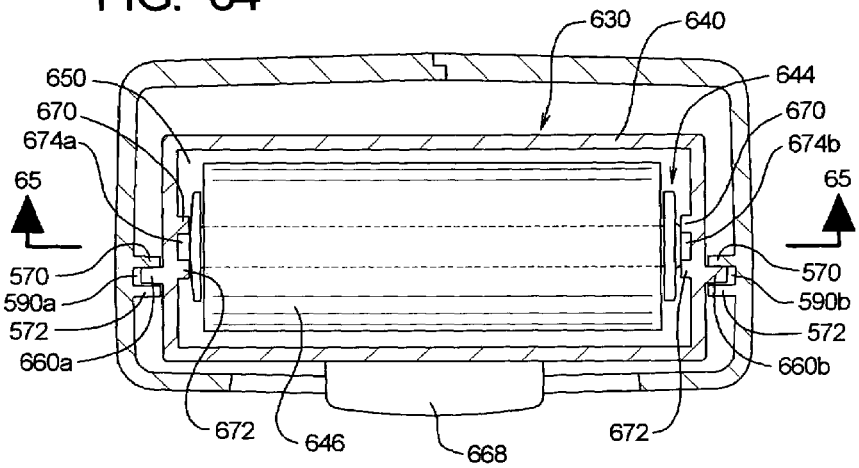
FIG. 64 is a section view illustrating a cartridge assembly and handle assembly of the material processing system of FIG. 55.

The handle portions 540 and 542 thus define first and second cartridge channels 590*a* and 590*b* as shown in FIG. 64, but only one of the channels 590*a* and 590*b* can be depicted in FIGS. 61-63. The cartridge channels 590 each define a rail axis $A_R$ and a storage axis $A_S$.

When the handle portions 540 and 542 are joined together to form the handle assembly 530, the stop walls 74 define a stop opening 96 and the pin walls 76 define a pin opening 98.

In the example housing system 530, the cavities 548 are formed on the first handle portion 540, while the corresponding bosses are formed on the second handle portion 542. In other respects, the example first and second handle portions 540 and 542 are substantially symmetrical about a plane defined by the parting line 544 as will be apparent from the following discussion.

The handle assembly 530 may be embodied in forms other than those described above. For example, the handle portions 540 and 542 need not be symmetrical about the parting line 544, and the parting line 544 can be formed in other locations. In addition, the connecting system 546 may be formed by any method of connecting two parts together such as adhesives, screws, detent clips, friction, and combinations thereof. As shown and described, the handle assembly 530 can easily be mass produced of injection-molded plastic, but other materials and manufacturing techniques can be used.

Turning now back to FIGS. 55 and 57, the stamp wheel assembly 532 will now be described in further detail. The stamp wheel assembly 532 comprises a wheel drum 610, a wheel axle 612, and wheel spokes 614. The wheel axle 612 is substantially cylindrical and comprises an inner portion 616 and reduced-diameter outer portions 618.

The outer portions 618 of the axle 612 are sized and dimensioned to be snugly received within the wheel notches 560. More specifically, the outer portions 618 snap into the wheel notches 560 to allow the stamp wheel assembly 532 to be detachably attached to the handle assembly 530. With the outer portions 618 so received by the wheel notches 560, the inner portion 616 centers the wheel assembly 532 relative to the wheel opening 50, and the wheel assembly 532 can rotate about the axis of the axle 612 relative to the handle assembly 530.

The wheel drum 610, wheel axle 612, and wheel spokes 614 are all preferably integrally formed of injection-molded plastic, but other materials and manufacturing techniques may be utilized. In addition, these components may be separately manufactured and assembled to form the stamp wheel assembly 532.

A stamp portion 120 is formed on the wheel drum 610. The example stamp portion 120 is a layer of rubber stamp material defining a stamp surface 122. The image 522 is formed in bas relief on the stamp surface 122 in a conventional manner. Different wheel assemblies can be attached to the handle assembly 530 to obtain different images 522.

The example inking system 534 will now be described in further detail with reference to FIGS. 58, 59, 60, 64, and 65. The inking system 534 comprises a cartridge assembly 630 and a biasing assembly 632. The cartridge assembly 630 comprises a housing member 640, a cover member 642, an axle assembly 644, and an inking member 646. The inking member 646 defines a through-hole 648.

Figure 59:
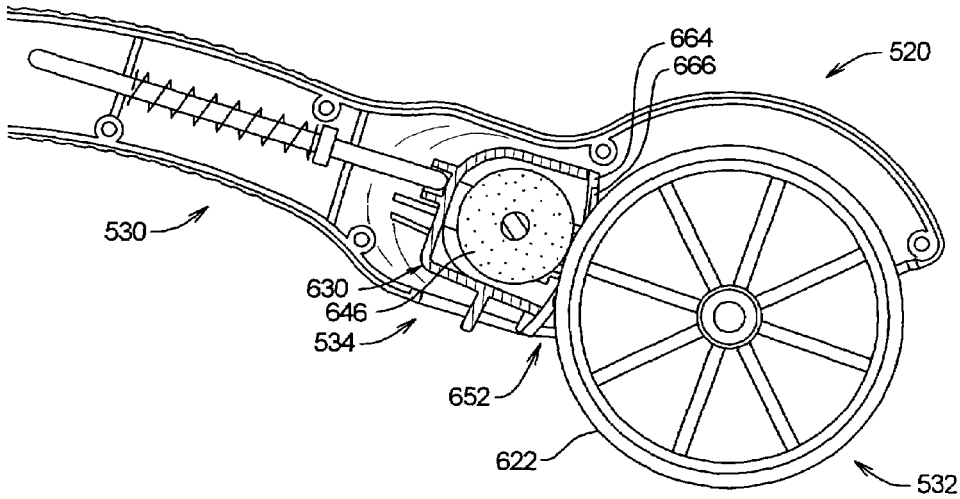
Figure 60:
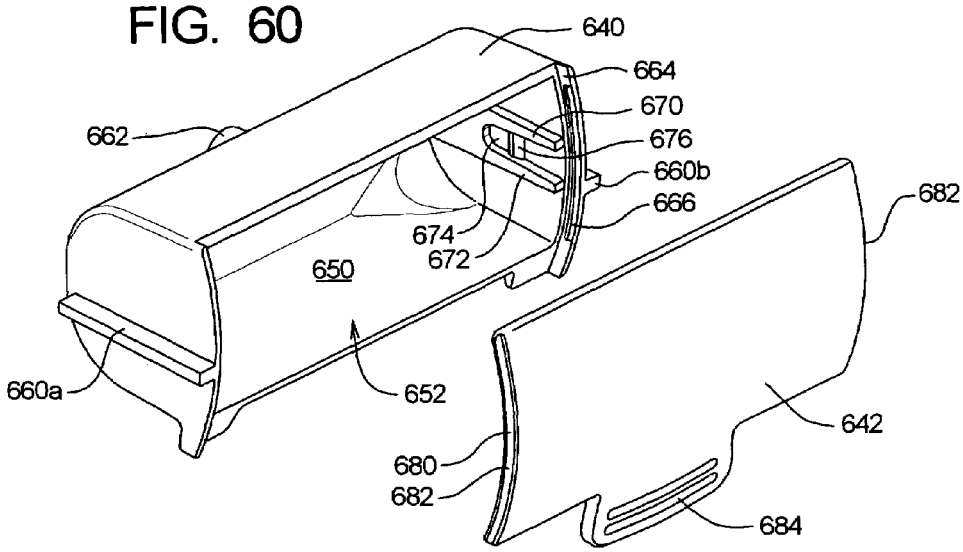
FIG. 60 is an exploded view of a cartridge handle assembly of the present invention.

As perhaps best shown in FIGS. 58 and 60, the example housing member 640 defines a cartridge chamber 150 and a cartridge opening 152. As shown in FIGS. 59 and 60, the housing member 640 further comprises guide rails 660 and a pin socket 662. The housing member 640 further defines housing flanges 664 extending along opposite sides of the cartridge opening 152. Housing ribs 666 extend at least partly along the housing flanges 664. A cartridge grip 668 extends from the housing member 640.

As perhaps best shown in FIGS. 60 and 64, extending from the example housing member 640 within and on opposite sides of the cartridge chamber 150 are pairs of upper and lower axle guides 670 and 672 each defining an axle channel 674. A lock projection 676 extends into each axle channel 674.

FIG. 60 further illustrates that the example cover member 642 defines a cover flange 680 formed on each lateral edge 682 of the member 642. The cover member 642 further comprises a cover handle 684 located between the lateral edges 682.

The housing member 640 and cover member 642 of the example cartridge assembly 630 are made of injection-molded plastic, but other materials and manufacturing techniques may be utilized.

Referring now to FIG. 58, the example biasing assembly 632 will now be described. The biasing assembly 632 comprises a biasing pin 690 and a biasing spring 692. The biasing pin 690 comprises a shaft 694 and a collar 696. The collar 696 bears on the biasing spring 692 during normal use as will be described in further detail below. The biasing pin 690 is preferably made of injection-molded plastic but can be made using other materials and/or other manufacturing techniques. The example biasing spring 692 is a helical metal compression spring, and a portion of the shaft 694 of the biasing pin 690 extends through the center of the biasing spring 692. The biasing spring 692 may also be manufactured using other materials and manufacturing processes.

Figure 65:
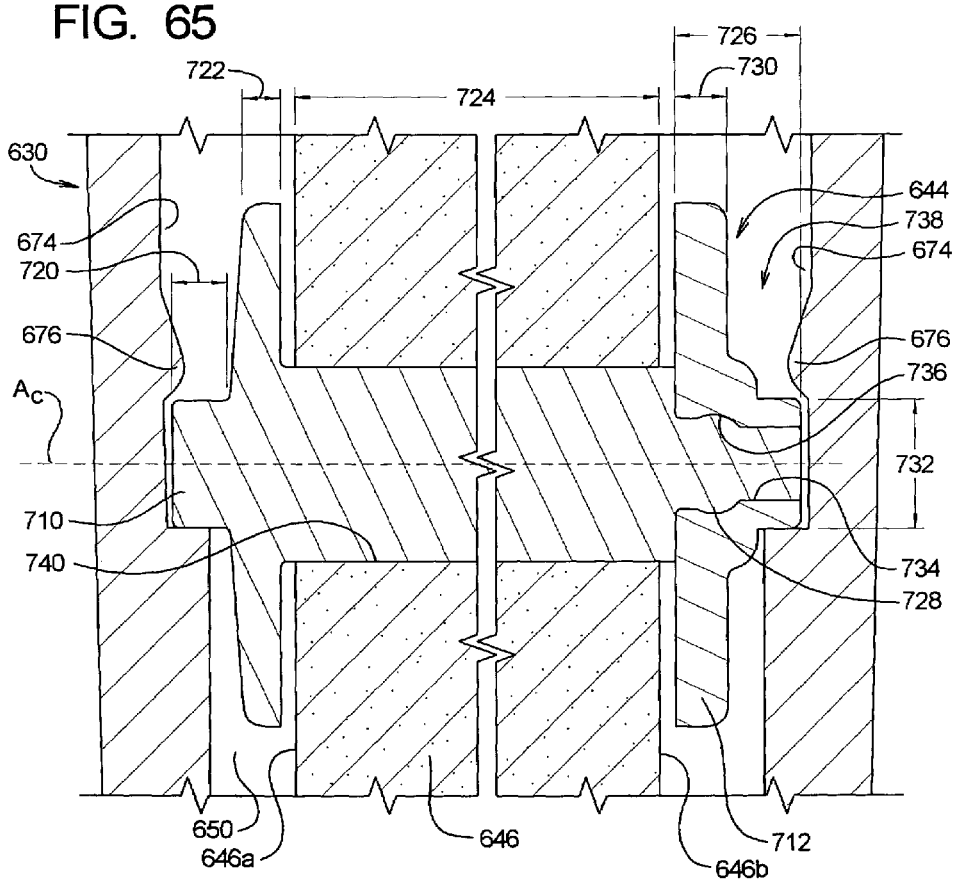
FIG. 65 is a section view of the material processing system of FIG. 55 taken along lines 65-65 in FIG. 64.

Referring now to FIG. 65, the axle assembly 644 and inking member 646 of the inking system 534 will be described in further detail. The example axle assembly 644 comprises an axle member 710 and an axle cap 712. The axle member 710 comprises a first engaging portion 720, a first flange portion 722, a center portion 724, and a mounting portion 726. A mounting projection 728 extends from the mounting portion 726. The axle cap 712 comprises a second flange portion 730 and a second engaging portion 732. A cap opening 734 extends through the axle cap 712. A mounting cavity 736 is formed on the axle cap 712 within the cap opening 734.

As best shown in FIG. 65, the mounting projection 728 and the mounting cavity 736 form a mounting system 738. The example mounting system 738 forms a snap fit that detachably attaches the axle cap 712 onto the axle member 710.

The axle member 710, axle cap 712, and inking member 646 of the example axle assembly 644 are all substantially symmetrical about a cartridge axis $A_C$ when assembled. In particular, the first and second flange portions 722 and 730 are disc or washer shaped and the center portion 724 and engaging portions 720 and 732 are cylindrical. In addition, the example mounting projection 728 and mounting cavity 736 are annular and have substantially the same cross-sectional areas.

The axle member 710 and axle cap 712 are preferably formed of injection-molded plastic. The axle assembly 644 can be manufactured of other materials and in other configurations, however. For example, an integrally formed axle member defining both of the flange portions can be used in place of an assembly of two parts as described above. Another viable configuration of the axle assembly 644 is to use a single axle member with first and second flange members; the axle member would define the center portion, while the flange members would define the engaging and flange portions.

The mounting system 738 can be eliminated or can take other forms depending upon the structure used to define the engaging portions, flange portions, and center portion. For example, if the engaging portions, flange portions, and center portion are integrally formed on a single part, no mounting system is required. If the engaging and flange portions are formed on separate flange members, the mounting system can be formed by snap fits on each end of an axle member that defines the center portion. And instead of a snap fit, the mounting system can be formed by threads, adhesives, spin-welding, or the like.

The material processing system 520 is assembled as follows. Initially, the shaft 694 of the biasing pin 690 is inserted through the biasing spring 692 until one end of the spring 692 comes into contact with the pin collar 696. The combination of the pin 690 and the spring 692 is arranged such that the pin 690 rests on the stop wall 574 and pin wall 576 of the first handle portion 540 with the spring 692 between the stop wall 574 and pin wall 576.

The second handle portion 542 is then placed on the first handle portion 540 with the stop walls 74 and pin walls 76 engaging each other to form the stop opening 96 and the pin opening 98. The shaft 694 extends through the stop opening 96 and pin opening 98 with the spring 692 contained within the spring chamber 578 as shown in FIG. 58. The handle assembly 530 and biasing assembly 632 are formed at this point. Typically, the handle assembly 530 and biasing assembly 632 are formed at the factory.

The cartridge assembly 630 is separately assembled as follows. Initially, the axle member 710 is displaced such that the mounting portion 726 thereof passes through, and the center portion 724 thereof lies within, the inking member through-hole 740. At this point, the first flange portion 722 is adjacent to a first side surface 646*a* of the inking member 646.

The axle cap 712 is then displaced until the mounting portion 726 of the axle member 710 is received by the cap opening 734 in the cap 712. The application of deliberate force on the axle cap 712 causes the mounting cavity 736 defined by the axle cap 712 to receive the mounting projection 728 defined by the axle member 710. The mounting projection 728 thus positively engages the axle cap 712 to inhibit inadvertent removal of the cap 712 from the axle member 710. At this point, the axle assembly 644 is formed, and the second flange portion 730 is adjacent to a second side surface 646*b* of the inking member 646.

The axle assembly 644 and inking member 646 are then detachably attached to the housing member 640 to form the cartridge assembly 630. In particular, the first and second engaging portions 720 and 732 are displaced along the axle channels 674 formed on the opposite sides of the cartridge chamber 150. When the engaging portions 720 and 732 engage the lock projections 676, further deliberate application of force on the axle assembly 644 deforms the housing member 640 slightly to allow the engaging portions 720 and 732 to pass over the lock projections 676.

After the engaging portions 720 and 732 continue along the axle channels 674 past the lock projections 676, the axle assembly 644 enters a loaded position as shown in FIG. 65. In the loaded position, the axle assembly 644 and inking member 646 rotate relative to the housing member 640, but the lock projections 676 prevent inadvertent removal of the axle assembly 644 from the housing member 640. The axle assembly 644 and inking member 646 can, however, be removed by deliberate application of manual force on the axle assembly 644 to deform the housing member 640, thereby allowing the engaging portions 720 and 732 to pass over the lock projections 676 and out of the axle channels 674.

The cover member 642 is then detachably attached to the housing member 640 by sliding the cover flanges 680 underneath the housing ribs 666 on the housing flanges 664. The cover flanges 680 frictionally engage the housing ribs 666 to inhibit inadvertent removal of the cover member 642 from the housing member 640 (FIG. 58). However, deliberate application of manual force on the cover member 642, and in particular on the cover handle 684, easily allows the cover member 642 to be removed from the housing member 640 (FIG. 59) when desired.

The entire cartridge assembly 630 is then attached to the handle assembly 530 as shown in FIGS. 61-63. In particular, with the stamp wheel assembly 532 removed, the cartridge assembly 630 is inserted through the wheel opening 50 with the guide rails 660 on the housing member 640 generally aligned with the cartridge channels 590 on the handle portions 540 and 542 as shown in FIG. 61. At this point, the pin socket 662 on the cartridge housing member 640 receives a forward end of the pin shaft 694. The opening portion 580 of the upper guide wall 570 and the funnel portion 584 of the lower guide wall 572 facilitate alignment of the guide rails 660 with the cartridge channels 590.

The cartridge assembly 630 is then displaced away from the wheel opening 50 into the handle assembly 530. The guide walls 70 and 72 engage the guide rails 660 such that the rails 660 move and along the rail axis $A_R$ defined the cartridge channels 590. As the cartridge assembly 630 moves rearwardly into the handle assembly 530, the biasing pin 690 is also displaced rearwardly, and the spring 692 is compressed by the pin collar 696. The cartridge grip 668 and/or cover handle 684 facilitate rearward movement of the cartridge assembly 630 against the force of the spring 692.

Continued movement of the cartridge assembly 630 toward the rear of the handle assembly 530 places the cartridge assembly 630 in a release position relative to the cartridge channel 590 as shown in FIG. 62. In the release position, the cartridge assembly 630 is substantially parallel to the rail axis $A_R$ of the cartridge channel 590 and is free to move towards the front of the handle assembly 530.

In contrast, FIGS. 58 and 63 illustrate the cartridge assembly 630 in a storage position in which the cartridge assembly 630 is angled slightly with respect to the cartridge channel 590. In the storage position, the cartridge assembly 630 is angled such that it is aligned with the storage axis $A_S$ defined by the cartridge channel 590, and a portion of the cartridge assembly 630 engages the latch portion 586 of the lower guide wall 572 to prevent frontward movement of the assembly 630 relative to the handle assembly 530. The cartridge assembly 630 is placed into the storage position by tilting or pivoting the cartridge assembly down using one or both of the cartridge grip 668 and/or cover handle 684 and then allowing the biasing spring 692 to force the cartridge assembly 630 against the latch portion 586.

The cartridge notch 562 at the rear portion of the wheel opening 50 accommodates the cartridge grip 668 when the cartridge assembly 630 is in the release and storage positions.

The stamp wheel assembly 532 is or may be conventional, and the construction of the example stamp wheel assembly 532 will not be described herein in further detail. As perhaps best shown in FIG. 58, a gap 750 exists between the cartridge assembly 630 and the stamp wheel assembly 532 when the cartridge assembly 630 is in the storage position. The stamp wheel assembly 532 is thus attached to the handle assembly 530 when the cartridge assembly 630 is in the storage position.

To use the material processing system 520, the cover member 642 is removed from the housing member 640 by applying a force on the cover handle 684 in the direction shown by arrow A in FIG. 58. The cartridge assembly 630 is then placed in the release position, at which point the biasing spring 692 forces the inking member 646 forward into contact with the stamp surface 122 as shown in FIG. 59. As is conventional, the inking member 646 is impregnated with ink that is transferred to the stamp surface 122.

The handle assembly 530 is then displaced such that the stamp surface 122 comes into contact with the image surface 524 on which the image or images 522 are to be formed. The handle assembly 530 is then displaced forward as shown in FIG. 55 such that the stamp wheel assembly 532 rolls about its axle 612. The rotation of the stamp wheel assembly 532 is frictionally transferred to the inking member 646 such that the inking member 646 rotates about the axis of the axle assembly 644 of the cartridge assembly 630. As the material processing system 520 is moved along the image surface 524, ink is continuously transferred from the inking member 646 to the stamp surface 122 and from the stamp surface 122 to the image surface 524.

Optionally, the cover member 642 may be left in place and the cartridge assembly 630 left in the storage position; in this case, no ink will be applied to the stamp surface 122. Instead, if the material forming the surface 524 is soft, such as clay, the shape of the stamp surface 122 will be impressed into the material being processed.

As is conventional, the inking member 646 is made of a compressible absorbent material impregnated with ink. The compressibility of the inking member 646 allows ink to be evenly distributed on the stamp surface 122. Accordingly, as the stamp wheel assembly 532 rotates and engages the inking member 646, the stamp wheel assembly 532 compresses the inking member 646. The flange portions 722 and 730 engage the first and second sides **646*a* and 646*b* of the inking member 646 to ensure that the inking member 646 does not deform in a manner that does not completely cover the stamp surface 122** with ink.

From the foregoing, it should be apparent that the present invention may be embodied in many different combinations and sub-combinations of the elements and steps described above. The scope of the present invention should thus be determined by the following claims and not the foregoing detailed description.

I claim:

1. A stamping system for forming a continuous image on an image surface, the stamping system comprising:

a handle assembly comprising first and second pairs of guide walls, where the first and second pairs of guide walls define first and second cartridge channels, respectively, and at least one of the guide walls defines a latch portion;

stamp wheel rotatably attached to the handle assembly, where the stamp wheel defines a stamp surface; and an inking system comprising a cartridge assembly comprising an inking member defining a through-hole and first and second side surfaces, an axle comprising a center portion and first and second flange portions, where axle supports the inking member such that the center portion lies within the through-hole and the first and second flange portions extend at least partly along the first and second side surfaces, and a housing member for supporting the axle for movement relative to the handle assembly, where first and second rails extend from the housing member, and a biasing assembly supported by the handle assembly for applying a force on the housing member; whereby the first and second cartridge channels receive the first and second rails such that the cartridge assembly moves between operational and storage positions relative to the handle assembly;

when the cartridge assembly is in the storage position, at least one of the first and second rails engage the latch portion to space the inking member from the stamp wheel against the force of the biasing assembly; and when the cartridge assembly is in the operational position, the first and second rails are disengaged from the latch portion such that the biasing assembly forces the inking member into contact with the stamp wheel.

2. A stamping system as recited in claim 1, in which the axle comprises:

an axle member defining the center portion and the first flange portion; and an axle cap defining the second flange portion.

3. A stamping system as recited in claim 2, in which:

the axle member further defines a mounting portion; and the axle cap is configured to receive the mounting portion of the axle member to detachably attach the axle cap to the axle member.

4. A stamping system as recited in claim 3, in which:

the mounting portion of the axle member defines a mounting projection; and the axle cap defines a cap opening configured to receive the mounting projection on the axle member.

5. A stamping system as recited in claim 4, in which a mounting cavity is formed in the axle cap, where the mounting cavity is sized and dimensioned to receive the mounting projection when the axle cap is attached to the axle member.

6. A stamping system as recited in claim 5, in which the mounting projection and the mounting cavity are annular.

7. A stamping system as recited in claim 1, in which:

the first and second pairs of guide walls define first and second latch portions, respectively; and the first and second rails engage the first and second latch portions, respectively, when the cartridge assembly is in the storage position.

8. A stamping system as recited in claim 7, in which the first and second cartridge channels are configured such that the cartridge assembly may further be placed in a release position in which the cartridge assembly may move towards the stamp wheel.

9. A stamping system as recited in claim 1, in which the biasing assembly comprises:

a biasing pin supported by the handle assembly for movement between first and second positions; and a biasing spring for assisting movement of the biasing pin towards the first position; whereby the biasing pin engages the housing member such that the housing member forces the biasing pin towards the second position.

10. A method of forming a continuous image on an image surface comprising the steps of:

providing a handle assembly comprising first and second pairs of guide walls, where the first and second pairs of guide walls define first and second cartridge channels, respectively, and at least one of the guide walls defines a latch portion;

rotatably attaching a stamp wheel to the handle assembly, where the stamp wheel defines a stamp surface; and providing an inking member defining a through-hole and first and second side surfaces, providing an axle comprising a center portion and first and second flange portions;

supporting the inking member on the axle such that the center portion lies within the through-hole and the first and second flange portions extend at least partly along the first and second side surfaces;

providing a housing member, where first and second rails extend from the housing member;

forming a cartridge assembly by attaching the axle to the housing member;

arranging the first and second rails within the first cartridge channels to support the cartridge assembly relative to the handle assembly for movement between an operational position in which the inking member is in contact with the stamp surface of the stamp wheel, and a storage position in which the inking member is spaced from the stamp wheel;

applying a force on the housing member to force the cartridge assembly into the operational position; and engaging at least one of the first and second rails with the latch portion such that the latch portion holds the cartridge assembly in the storage position.

11. A method as recited in claim 10, in which the step of providing the axle comprises the steps:

providing an axle member defining the center portion and the first flange portion;

providing an axle cap defining the second flange portion; and attaching the axle cap to the axle member.

12. A method as recited in claim 11, in which:

the step of providing the axle member further comprises the step of forming a mounting portion on the axle member; and the step of providing the axle cap comprises the step of configuring the axle cap to receive the mounting portion of the axle member to detachably attach the axle cap to the axle member.

13. A method as recited in claim 12, in which:

the step of forming the mounting portion on the axle member comprises the step of forming a mounting projection; and the step of configuring the axle clap comprises the step of forming a cap opening in the axle cap configured to receive the mounting projection on the axle member.

14. A method as recited in claim 13, further comprising the step of forming a mounting cavity in the axle cap, where the mounting cavity is sized and dimensioned to receive the mounting projection when the axle cap is attached to the axle member.

15. A method as recited in claim 14, in which the mounting projection and the mounting cavity are annular.

16. A method as recited in claim 10, in which:

the step of providing the handle assembly comprises the step of configuring the first and second pairs of guide walls to define first and second latch portions, respectively; and the step of engaging at least one of the first and second rails with the latch portion comprises the step of engage the first and second rails with the first and second latch portions, respectively.

* * * * *